US005955974A

United States Patent [19]

Togawa

[11] Patent Number: 5,955,974

[45] Date of Patent: Sep. 21, 1999

[54] INFORMATION PROCESSING APPARATUS WITH TRANSFER OR ARRIVAL PRECAUTION

[75] Inventor: Yoshifusa Togawa, Kawasaki, Japan

[73] Assignee: Fujitsu Limited, Kawasaki, Japan

[21] Appl. No.: 09/041,770

[22] Filed: Mar. 13, 1998

[30] Foreign Application Priority Data

Sep. 11, 1997 [JP] Japan ..... 9-247302

[51] Int. Cl.[6] ..... G08G 1/123

[52] U.S. Cl. ..... 340/994; 340/995; 340/988; 340/990; 340/996; 340/991; 340/539; 701/202; 701/207; 701/209; 701/210; 701/213

[58] Field of Search ..... 340/994, 995, 340/988, 990, 996, 991, 539; 711/109; 455/269, 348, 351; 343/702; 361/686, 737; 439/357, 916; 701/202, 209, 210, 207, 213; 434/116, 365

[56] References Cited

U.S. PATENT DOCUMENTS

| | | | |
|---|---|---|---|
| 5,172,321 | 12/1992 | Ghaem et al. | 701/202 |
| 5,470,233 | 11/1995 | Fruchterman et al. | 434/112 |
| 5,483,234 | 1/1996 | Carreel et al. | 340/994 |
| 5,493,295 | 2/1996 | Lewiner et al. | 340/994 |
| 5,543,789 | 8/1996 | Behr et al. | 340/995 |
| 5,606,732 | 2/1997 | Vignone, Sr. | 455/269 |
| 5,736,940 | 4/1998 | Burgener | 340/994 |
| 5,774,827 | 6/1998 | Smith, Jr. et al. | 701/209 |

FOREIGN PATENT DOCUMENTS

| | | |
|---|---|---|
| 61-095495 | 5/1986 | Japan . |
| 1-245724 | 9/1989 | Japan . |
| 1-297920 | 12/1989 | Japan . |
| 1-305453 | 12/1989 | Japan . |
| 5-069828 | 3/1993 | Japan . |
| 5-282317 | 10/1993 | Japan . |
| 6-138821 | 5/1994 | Japan . |
| 6-152503 | 5/1994 | Japan . |
| 6-318919 | 11/1994 | Japan . |
| 7-030959 | 1/1995 | Japan . |
| 8-018501 | 1/1996 | Japan . |

*Primary Examiner*—Benjamin C. Lee
*Attorney, Agent, or Firm*—Staas & Halsey, LLP

[57] ABSTRACT

An information processing apparatus carried by a user, with which the user can work while moving to a place or transferring or a destination utilizing transport facilities such as a train, a bus and the like, has a receiving-recognizing unit for receiving information for recognizing the present position during the move to the place for transferring or the destination as a signal from the outside to recognize the present position during the move from the received signal, and a notifying unit for displaying a positional relation between present position information recognized by the receiving-recognizing unit and the place for transferring or the destination in the transport facilities in a state of work operation to notify of transfer or arrival precaution information. The information processing apparatus notifies the user that the user arrives at the place for transferring or the destination so that the user is prevented from riding past and can concentrate the work.

15 Claims, 28 Drawing Sheets

FIG. 4

16A

| MODE SETTING VALUE | CHANGED ATTRIBUTE AT THE TIME OF TRANSFER | CHANGED ATTRIBUTE AT THE TIME OF ARRIVAL |
|---|---|---|

MODE SETTING VALUE

X X X X X X X X

- X (8th bit): SWITCHING FLAG TO OPEN / CLOSE THE WINDOW FOR MEMORANDUM AT THE TIME OF TRANSFER / ARRIVAL
- X (4th bit): VIBRATION
- X (3th bit): SOUNDS
- X (2nd bit): WINDOW SCREEN
- X (1st bit): IMAGE ( NOTIFYING IN ANIMATION DURING AN OPERATION, FOR EXAMPLE )

CHANGED ATTRIBUTE AT THE TIME OF TRANSFER / CHANGED ATTRIBUTE AT THE TIME OF ARRIVAL

- A VALUE OF AMPLITUDE ; INCREASING THE AMPLITUDE AS GETTING CLOSER
- CHANGING A PITCH OF SOUNDS OR CHANGING THE SOUNDS, CHANGING A PITCH OF SOUNDS OR CHANGING THE SOUNDS AS GETTING CLOSER
- TEXT ; CHANGING CONTENTS OF THE TEXT OR INCREASING A SIZE OF DISPLAY OF THE WINDOW
- ANIMATION ; MAKING A VOICE OF A PERSON IN THE ANIMATION LOUDER, OR MAKING A MOTION OF THE PERSON MORE ACTIVELY
- STILL PICTURE ; ROCKING THE PICTURE

NOTICE FLAG

1: NOTIFY WHEN GETTING CLOSE TO THE PLACE FOR TRANSFERRING / THE DESTINATION

0: NOTIFY ONLY WHEN ARRIVING AT THE PLACE FOR TRANSFERRING / THE DESTINATION

INFORMATION PROCESSING APPARATUS WITH TRANSFER OR ARRIVAL PRECAUTION

BACKGROUND OF THE INVENTION (1) Field of the Invention

The present invention relates to an information processing apparatus with a transfer or arrival precaution notifying function suitable for use as an information processing apparatus carried by a user, with which the user can work while moving to a place for transferring or a destination utilizing transport facilities such as a train, a bus and the like, further relates to an apparatus for transmitting information for transfer or arrival precaution which transmits information to be used as transfer or arrival precaution information to the information processing apparatus, a transfer or arrival precaution notifying method and a computer readable record medium, in which a program operating a computer as the information processing apparatus is recorded, used in the above information processing apparatus.

(2) Description of Related Art

With a spread of portable information processing apparatus such as personal computers of a notebook type, various works are done with the above information processing apparatus in order to effectively use a time when a user of the information processing apparatus moves to a place for transferring/a destination (a place for transferring or a destination) utilizing public transport facilities such as a train, a bus and the like.

A necessity of doing various works with the above information processing apparatus while the user moves is great when the user hits on an idea during a move utilizing public transport facilities and wants to start the work immediately, or when a work that the user wants to do during a move occurs.

If the user hits on an idea while moving, the user often forgets the conceived idea due to time elapsing when starting to work in another place after getting off the vehicle. In many cases, the user has to start the work from recollecting the idea. This doubles labor of the work.

If the user of the information processing apparatus wants to work while moving, that is, if the user has a work whose due is approaching, or receives a request for a work over a communication network while moving, the work will be delayed if the user cannot work while moving.

When the user works with the above information processing apparatus while moving utilizing public transport facilities, the user has to always pay attention to whether the user arrives at a place for transferring (a place of a connection) or a destination (a place where the user gets off) so that it is difficult for the user to concentrate on the work.

To the contrary, if the user concentrates on the work, the user might not notice that the user arrives at a place for transferring/a destination, and fail to get off, and ride past. In particular, if a time of a move is more odds and ends such as one hour or two, the more the user might not notice that the user arrives at a place for transferring/a destination, fail to get off, and ride past.

As methods for notifying a passenger that the passenger arrives at a place for transferring/a destination, techniques are disclosed in Japanese Patent Application Laid-Open Publication Nos. 5-282317, 1-245724, 5-69828 and 61-95495.

Each of the techniques disclosed in the above publications relates to an apparatus that a passenger can carry, which generates, for example, sounds, vibration or the like when the passenger utilizing public transport facilities approaches a place for transferring/a destination so as to notify the passenger of it.

In each of the techniques disclosed in the above publications, the passenger has to always carry an apparatus for notifying the passenger that the passenger arrives at a place for transferring/a destination.

In the case where the passenger works with an information processing apparatus while moving in public transport facilities, it is difficult for the passenger to concentrate on the work since the passenger has to pay attention to a notice from the apparatus so that the passenger might stop the work although wanting to continue the work.

Further, when the apparatus generates sounds, vibration or the like to notify a passenger that the passenger arrives at a place for transferring/a destination, the passenger might confuse it with a call incoming of a portable telephone, a beeper or the like so that the notice of arrival at a place for transferring/a destination might not be correctly delivered.

When a passenger utilizes public transport facilities unfamiliar to the passenger, or when a notice is delivered in order to avoid passenger's ride past due to the passenger's doze, etc., the techniques disclosed in the above publications are effective. However, if the passenger works with an information processing apparatus while moving in public transport facilities, the above techniques are not effective from a viewpoint of work efficiency.

SUMMARY OF THE INVENTION

In the light of the above problems, an object of the present invention is to provide an information processing apparatus with a transfer or arrival precaution notifying function for notifying a user that the user arrives at a place for transferring or a destination when the user works with the information processing apparatus while moving in transport facilities, thereby preventing the user from riding past and enabling the user to concentrate on the work, and further to provide an apparatus for transmitting information for transfer or arrival precaution for transmitting information to be used as transfer or arrival precaution information to the information processing apparatus, and a transfer or arrival precaution notifying method and a computer readable record medium, in which a program operating a computer as the above information processing apparatus, for use in the information processing apparatus.

The present invention therefore provides an information processing apparatus with a transfer or arrival precaution notifying function carried by a user, with which the user can work while moving to a place for transferring or a destination utilizing transport facilities, comprising a receiving-recognizing unit for receiving information for recognizing the present position during a move to the place for transferring or the destination as a signal from the outside to recognize the present position during the move from the received signal, and a notifying unit for displaying a positional relation between the present position information recognized by the receiving-recognizing unit and the place for transferring or the destination in a state of work operation, thereby notifying of transfer or arrival precaution information.

The present invention further provides an information processing apparatus with a transfer or arrival precaution notifying function carried by a user, with which the user can work while moving to a place for transferring or a destination utilizing transport facilities, comprising a position detecting signal receiving unit for receiving a signal for detecting the present position during the move from a geostationary satellite while the information processing apparatus moves to the place for transferring or the destination, a present position information detecting unit for detecting the present position during the move on the basis of the received signal from the position detecting signal receiving unit, a transfer or arrival position table in which position information relating to the place for transferring or the destination is registered in advance, a positional relation extracting unit for extracting a positional relation between the present position and the place for transferring or the destination by referring to the transfer or arrival position table on the basis of the present position detection information detected by the present position information detecting unit, and a displaying unit for interrupting a state of another work to display the positional relation extracted by the positional relation extracting unit as transfer or arrival precaution information.

The present invention still further provides an information processing apparatus with a transfer or arrival precaution notifying function carried by a user, with which the user can work while moving to a place for transferring or a destination utilizing transport facilities, comprising a transmitting unit for transmitting a signal for notifying of a present position to a remote apparatus, a positional relation information receiving unit for receiving information relating to a positional relation between the present position and the place for transferring or the destination extracted correspondingly to the signal having been transmitted by the transmitting unit from the remote apparatus, and a displaying unit for interrupting a state of another work to display the positional relation received by the positional relation information receiving unit as transfer or arrival precaution information.

The information processing apparatus with a transfer or arrival precaution notifying function according to this invention recognizes the present position of the information processing apparatus during a move, and displays a positional relation between the recognized present position information and a place for transferring or a destination in transport facilities in a state of work operation. It is thereby possible for a user of the information processing apparatus to avoid ride past and concentrate on the work even when working with the information processing apparatus while moving in the transport facilities since the user does not need to always pay attention to whether the user arrives at the place for transferring or the destination.

The present invention still further provides an apparatus for transmitting information for transfer or arrival precaution comprising a position detecting signal receiving unit for receiving a position detecting signal transmitted from an information processing apparatus in a state of work operation while the information processing apparatus moves to a place for transferring or a destination utilizing transport facilities, a present position information detecting unit for detecting the present position of the information processing apparatus during the move on the basis of the received signal from the position detecting signal receiving unit, a transfer or arrival position table in which position information relating to the place for transferring or the destination is registered in advance for each information processing apparatus, a positional relation extracting unit for extracting a positional relation between the present position and the place for transferring or the destination by referring to the transfer or arrival position table on the basis of the present position detection information detected by the present position detecting unit, and a transfer or arrival precaution information transmitting unit for transmitting the positional relation extracted by the positional relation extracting unit so that the information processing apparatus uses the positional relation as transfer or arrival precaution information to be notified.

The apparatus for transmitting information for transfer or arrival precaution according to this invention has the present position information detecting unit, the transfer or arrival position table and the positional relation extracting unit to confirm a transfer or arrival position in the apparatus for transmitting information for transfer or arrival precaution. It is therefore possible to decrease a memory capacity required in the information processing apparatus.

The present invention still further provides a transfer or arrival precaution notifying method used in an information processing apparatus carried by a user, with which the user works while moving to a place for transferring or a destination utilizing transport facilities, comprising the steps of a position detecting signal receiving step of receiving a signal for detecting a present position during the move from a geostationary satellite, a present position information detecting step of detecting the present position during the move on the basis of the received signal obtained at the position detecting signal receiving step, a positional relation extracting step of extracting a positional relation between the present position detected at the present position information detecting step and the place for transferring or the destination set in advance for each information processing apparatus, and a displaying step for interrupting a state of another work to display the positional relation extracted at the positional relation extracting step as transfer or arrival precaution information.

The present invention still further provides a transfer or arrival precaution notifying method used in an information processing apparatus carried by a user, with which the user works while moving to a place for transferring or a destination utilizing transport facilities, comprising the steps of a transmitting step of transmitting a signal for notifying the present position from the information processing apparatus to a remote apparatus, a position detecting signal receiving step of receiving the position detecting signal transmitted from the information processing apparatus by the remote apparatus, a present position information detecting step of detecting the present position of the information processing apparatus during the move on the basis of the received signal obtained at the position detecting signal receiving step, a positional relation extracting step of extracting a positional relation between the present position detected at the present position information detecting step and the place for transferring or the destination set in advance for each information processing apparatus, a transfer or arrival precaution information transmitting step of transmitting the positional relation extracted at the positional relation extracting step as transfer or arrival precaution information, a positional relation information receiving step of receiving information relating to the positional relation between the present position and the place for transferring or the destination extracted correspondingly to the signal transmitted at the transfer or arrival precaution information transmitting step by the information processing apparatus, and a displaying step of interrupting a state of another work to display the positional relation received at the positional relation information receiving step as transfer or arrival precaution information.

The present invention still further provides, a computer readable record medium in which a program used to operate the computer is recorded, the improvement comprising the program making the computer function as a receiving-recognizing means for receiving information for recognizing the present position during a move to a place for transferring or a destination in transport facilities as a signal from the outside to recognize the present position during the move from the received signal, and a notifying means for displaying a positional relation between the present position information recognized by the receiving-recognizing means and the place for transferring or the destination in the transport facilities to notify of transfer or arrival precaution information.

According to the transfer or arrival precaution notifying method and the computer readable record medium for use in the information processing apparatus according to this invention, the present position of the information processing apparatus during a move is recognized, and a positional relation between the recognized present position information and a place for transferring or a destination in transport facilities is displayed in a state of work operation. It is thereby possible for a user of the information processing apparatus to avoid ride past and concentrate on a work even when working with the information processing apparatus while moving in the transport facilities since the user does not need to always pay attention to whether the user arrives at the place for transferring or the destination.

BRIEF DESCRIPTION OF THE DRAWINGS

FIG. 4 is a diagram showing a structure of a mode setting table;

Figure 1:
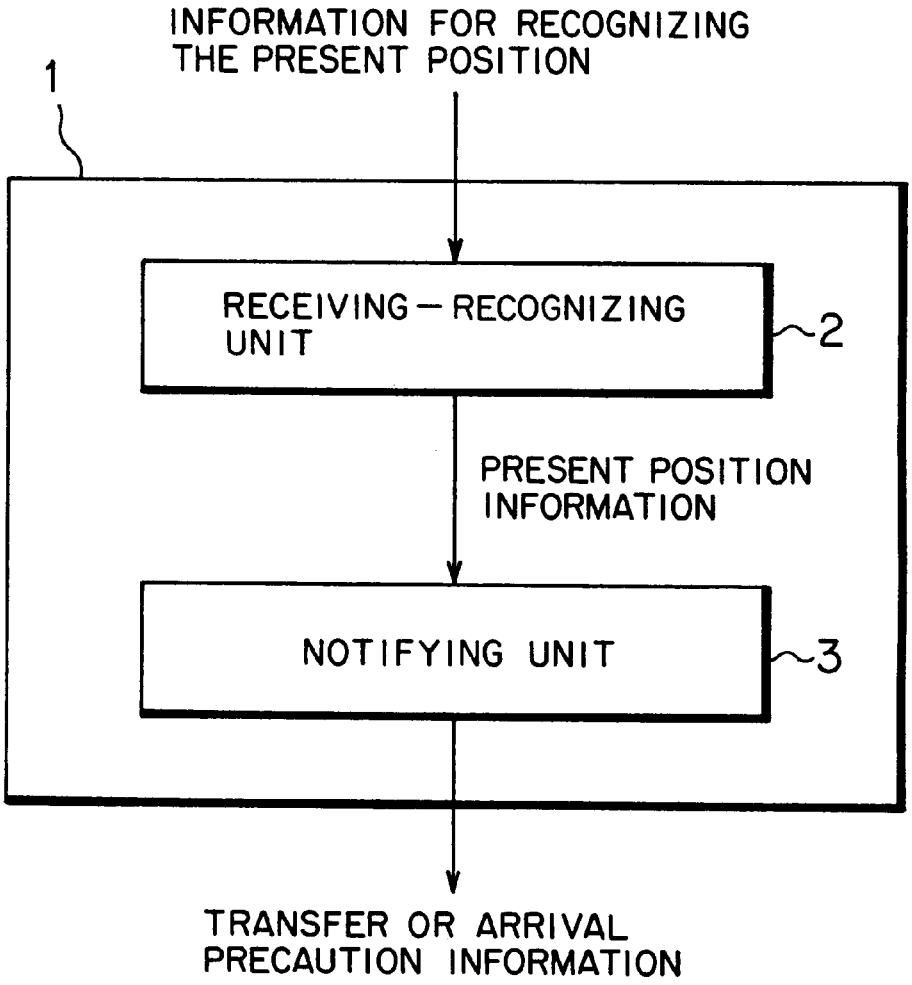
FIG. 1 is a block diagram showing an aspect of a structure of an information processing apparatus with a transfer or arrival precaution notifying function according to this invention.

DESCRIPTION OF THE PREFERRED EMBODIMENTS (a) Description of an Aspect of the Invention Now, description will be made of an aspect of this invention referring to the drawing.

FIG. 1 is a block diagram showing an aspect of a structure of an information processing apparatus with a transfer or arrival precaution notifying function.

The information processing apparatus 1 with a transfer or arrival precaution notifying function shown in FIG. 1 is an information processing apparatus carried by a user, with which the user can work while moving to a place for transferring or a destination utilizing transport facilities. The information processing apparatus 1 has a receiving-recognizing unit 2 and a notifying unit 3.

The receiving-recognizing unit 2 receives information for recognizing the present position during a move to the place for transferring or the destination as a signal from the outside, and recognizes the present position during the move from the received signal.

The notifying unit 3 displays a positional relation between the present position information recognized by the receiving-recognizing unit 2 and the place for transferring or the destination in transport facilities, thereby notifying of it as transfer or arrival precaution information.

More concretely, the information processing apparatus 1 with a transfer or arrival precaution notifying function carried by a user, with which the user can work while moving to a place for transferring or a destination utilizing transport facilities, has a position detecting signal receiving unit for receiving a signal for detecting the present position during the move to the place for transferring or the destination from a geostationary satellite while the information processing apparatus moves to the place for transferring or the destination, a present position information detecting unit for detecting the present position during the move on the basis of the received signal from the position detecting signal receiving unit, a transfer or arrival position table in which position information relating to the place for transferring or the destination is registered in advance, a positional relation extracting unit for extracting a positional relation between the present position and the place for transferring or the destination by referring to the transfer or arrival position table on the basis of the present position detection information detected by the present position information detecting unit, and a displaying unit for interrupting a state of another work to display the positional relation extracted by the positional relation extracting unit as transfer or arrival precaution information.

The information processing apparatus 1 may further have a move history tracing unit for tracing a move history utilizing the transport facilities on the basis of the present position information during the move from the present position information detecting unit, wherein the move history traced by the move history tracing unit is used as register information of the transfer or arrival position table. The transfer or arrival position table may be made on the basis of a habit of using the transport facilities.

The information processing apparatus 1 with a transfer or arrival precaution notifying function according to this invention recognizes the present position of the information processing apparatus 1 during a move and displays a positional relation between the recognized present position information and a place for transferring or a destination in transport facilities in a state of work operation so that a user of the information processing apparatus 1 does not need to always pay attention to whether the user arrives at the place for transferring or the destination even when working with the information processing apparatus while moving in the transport facilities. It is therefore possible for the user to avoid riding past and concentrate on the work.

A move history traced by the move history tracing unit may be used as register information of the transfer or arrival position table. The transfer or arrival position table may be made on the basis of a habit of using transport facilities. Whereby, the user does not need to register a moving route utilizing transport facilities in the transfer or arrival position table. Therefore, the operation may be simplified.

The information processing apparatus 1 with a transfer or arrival precaution notifying function carried by a user, with which the user can work while moving to a place for transferring or a destination utilizing transport facilities, has a transmitting unit for transmitting a signal for notifying of the present position to a remote apparatus, a positional relation information receiving unit for receiving information relating to a positional relation between the present position and the place for transferring or the destination extracted correspondingly to the above signal having been transmitted from the transmitting unit from the remote apparatus, and a displaying unit for interrupting a state of another work to display the above positional relation received by the positional relation information receiving unit as transfer or arrival precaution information.

At this time, the transmitting unit may transmit the signal for notifying of the present position to the remote apparatus via a geostationary satellite, or transmit the signal to the remote apparatus via the above transport facilities.

The information processing apparatus 1 with a transfer or arrival precaution notifying function shown in FIG. 1 may further have a memorandum window displaying unit for displaying a window for memorandum in which the user can record memorandum information when suspending the above work so as to resume the work in the next occasion.

In the information processing apparatus 1 with a transfer or arrival precaution notifying function, the notifying unit may increase a size of a display as the positional relation between the present position and the place for transferring or the destination gets closer.

The information processing apparatus 1 with a transfer or arrival precaution notifying function according to this invention recognizes the present position of the information processing apparatus 1 during a move and displays a positional relation between the recognized present position information and a place for transferring or a destination in transport facilities in a state of work operation so that a user of the information processing apparatus 1 does not need to always pay attention to whether the user arrives at the place for transferring or the destination even when working with the information processing apparatus while moving in the transport facilities. It is therefore possible for the user to avoid riding past and concentrate on the work.

The transmitting unit transmits the signal for notifying of the present position to the remote apparatus via the geostationary satellite. It is therefore possible to realize the transfer or arrival precaution notifying function without introducing an apparatus for transmitting and receiving the signal whenever a new line is installed or the line is changed in the transport facilities.

By providing the memorandum window displaying unit for displaying the window for memorandum when the user suspends the work, it is possible to minimize a time required to resume the suspended work even if the work is suspended because of transferring or the like so that continuity of the work can be kept.

An apparatus for transmitting information for transfer or arrival precaution according to this invention has a position detecting signal receiving unit for receiving a position detecting signal transmitted from an information processing apparatus in a state of work operation while moving to a place for transferring or a destination utilizing transport facilities, a present position information detecting unit for detecting the present position of the information processing apparatus during the move on the basis of the received signal from the position detecting signal receiving unit, a transfer or arrival position table in which position information relating to the place for transferring or the destination is registered in advance for each information processing apparatus, a positional relation extracting unit for extracting the positional relation between the present position and the place for transferring or the destination by referring to the transfer or arrival position table on the basis of the present position detection information detected by the present position information detecting unit, and a transfer or arrival precaution information transmitting unit for transmitting the positional relation extracted by the positional relation extracting unit so that the information processing apparatus uses the positional relation as transfer or arrival precaution information to be notified.

At this time, the apparatus for transmitting information for transfer or arrival precaution may further have a move history tracing unit for tracing a move history utilizing the transport facilities on the basis of the present position information during the move from the present position information detecting unit, and the move history traced by the move history tracing unit may be used as register information of the transfer or arrival position table. The transfer or arrival position table may be made on the basis of a habit of using the transport facilities.

Accordingly, the apparatus for transmitting information for transfer or arrival precaution of this invention has the present position information detecting unit, the transfer or arrival position table and the positional relation extracting unit so as to recognize a transfer or arrival position in it. It is therefore possible to decrease a memory capacity required in the information processing apparatus.

By using the move history traced by the move history tracing unit as the register information of the transfer or arrival position table, or by making the transfer or arrival position table on the basis of a habit of using the transport facilities, the user does not need to register a moving route utilizing the transport facilities in the transfer or arrival position table so that the operation can be simplified.

A transfer or arrival precaution notifying method according to this invention used in an information processing apparatus carried by a user, with which the user works while moving to a place for transferring or a destination utilizing transport facilities, comprises the steps of a position detecting signal receiving step of receiving a signal for detecting a present position during the move from the geostationary satellite, a present position information detecting step of detecting the present position during the move on the basis of the received signal obtained at the position detecting signal receiving step, a positional relation extracting step of extracting a positional relation between the present position detected at the present position information detecting step and a place for transferring or a destination set in advance for each information processing apparatus, and a displaying step of interrupting a state of another work to display the positional relation extracted at the positional relation extracting step as transfer or arrival precaution information.

A transfer or arrival precaution notifying method according to this invention used in an information processing apparatus carried by a user, with which the user works while moving to a place for transferring or a destination utilizing transport facilities, comprising the steps of a transmitting step of transmitting a signal for notifying of the present information to a remote apparatus, a position detecting signal receiving step of receiving the position detecting signal transmitted from the information processing apparatus by the remote apparatus, a present position information detecting step of detecting the present position of the information processing apparatus during the move on the basis of the received signal obtained at the position detecting signal receiving step, a positional relation extracting step of extracting a positional relation between the present position detected at the present position information detecting step and a place for transferring or a destination set in advance for each information processing apparatus, a transfer or arrival precaution information transmitting step of transmitting the positional relation extracted at the positional relation extracting step as transfer or arrival precaution information, a positional relation information receiving step of receiving information relating to the positional relation between the present position and the place for transferring or the destination extracted correspondingly to the signal transmitted at the transfer or arrival precaution information transmitting step by the information processing apparatus, and a displaying step of interrupting a state of another work to display the positional relation received at the positional relation information receiving step as transfer or arrival precaution information.

A computer readable record medium according to this invention is a computer readable record medium in which a program for operating a computer is recorded, wherein the program makes the computer function, as a receiving-recognizing means for receiving information for recognizing the present position during a move to a place for transferring or a destination as a signal from the outside to recognize the present position during the move from the received signal, and a notifying means for displaying a positional relation between the present position information recognized by the receiving-recognizing means and the place for transferring or the destination in a state of work operation to notify of the positional relation as transfer or arrival precaution information.

According to the transfer or arrival precaution notifying method and the computer readable record medium for use in an information processing apparatus of this invention, it is possible to recognize the present position of the information processing apparatus during a move, and display a positional relation between the recognized present position information and a place for transferring or a destination in transport facilities in a state of work operation so that a user of the information processing apparatus does not need to always pay attention to whether the user arrives at the place for transferring or the destination even when working with the information processing apparatus while moving in transport facilities. It is therefore possible for the user to avoid riding past and concentrate on the work.

(b) Description of a First Embodiment

Hereinafter, description will be made of embodiments of this invention with reference to the drawings.

Figure 2:
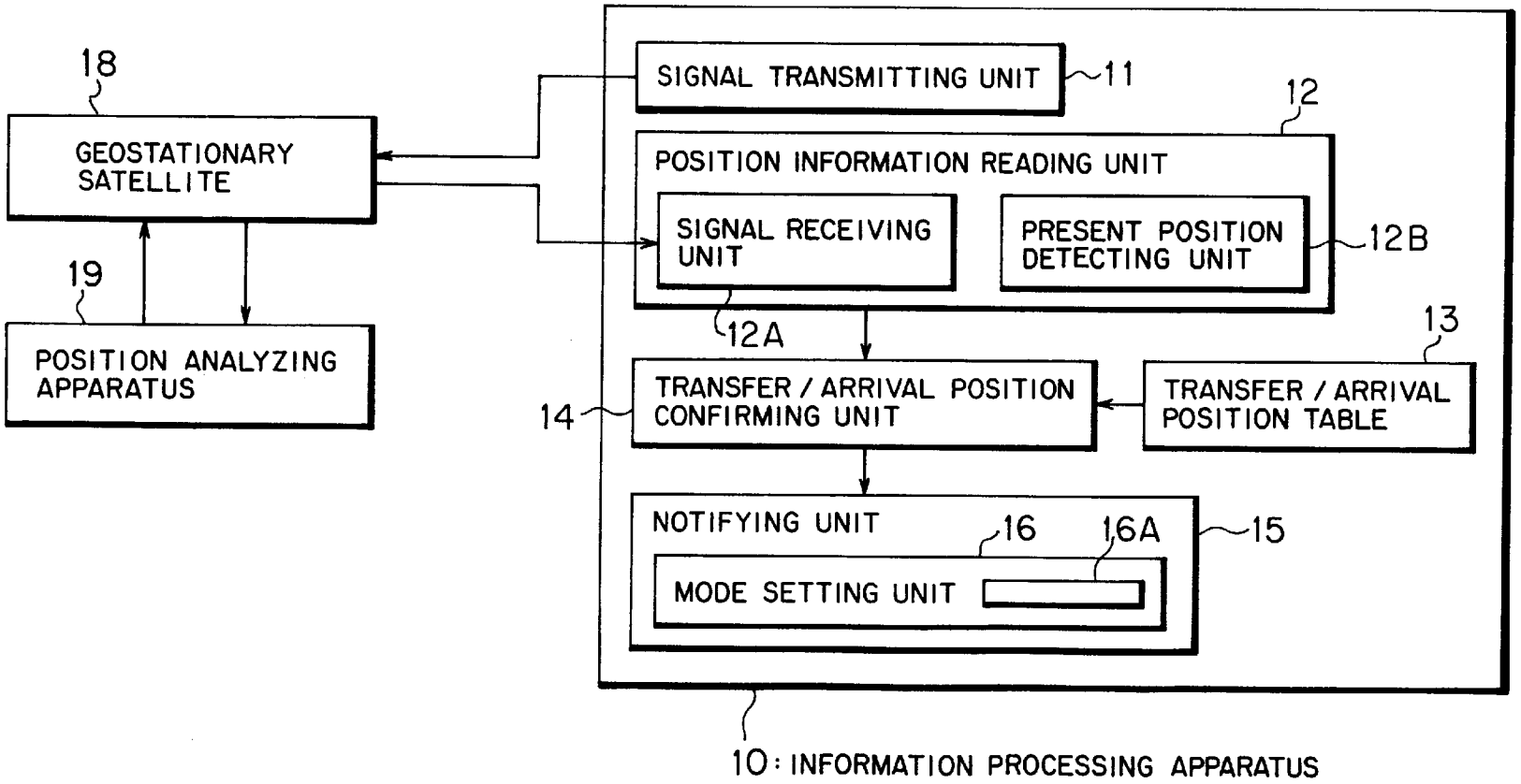
FIG. 2 is a block diagram showing a transfer/arrival precaution notifying system to which an information processing apparatus with a transfer/arrival precaution notifying function according to a first embodiment of this invention is applied.

FIG. 2 is a block diagram showing a transfer/arrival precaution notifying system to which an information processing apparatus with a transfer/arrival precaution notifying function according to the first embodiment of this invention is applied. The transfer/arrival precaution notifying system has an information processing apparatus 10, a geostationary satellite 18 and a position analyzing apparatus 19.

The information processing apparatus with a transfer/arrival precaution notifying function 10 shown in FIG. 2 is carried by a user (operator), with which the user can work while moving to a place for transferring/a destination (a place for transferring or a destination) utilizing transport facilities (for example, public transport facilities), which has a function of notifying the user that the user arrives at a place for transferring/a destination. Namely, the information processing apparatus 10 functions as an information processing apparatus with a transfer/arrival precaution notifying function.

The information processing apparatus 10 is a portable information processing apparatus such as a personal computer of a notebook type, which has a signal transmitting unit 11, a position information reading unit 12, a transfer/arrival position table 13, a transfer/arrival position confirming unit 14 and a notifying unit 15 in order to accomplish a function of notifying a user that the user arrives at a place for transferring/a destination as above.

The signal transmitting unit 11 transmits a position detecting signal for showing coordinates of the information processing apparatus 10 to the signal position analyzing apparatus 19 via the geostationary satellite 18.

The position information reading unit 12 receives information for recognizing the present position [the nearest station/place (the nearest station or place)] during a move to a place for transferring/a destination as a signal (a radio signal in this case) from the outside to recognize the present position during the move from the received signal, which functions as the receiving-recognizing unit.

In concrete, the position information reading unit 12 has a signal receiving unit (the position detecting signal receiving unit) 12A for receiving a signal for detecting the present position during a move to a place for transferring/a destination from the geostationary satellite 18, and a present position detecting unit (the present position information detecting unit) 12B for detecting the present position during a move on the basis of the received signal from the signal receiving unit 12A.

In the transfer/arrival position table 13, there is registered in advance position information relating to a place for transferring at which the user transfers or a final destination when the user utilizes public transport facilities. The transfer/arrival position table 13 functions as the transfer or arrival position table.

Figure 3:
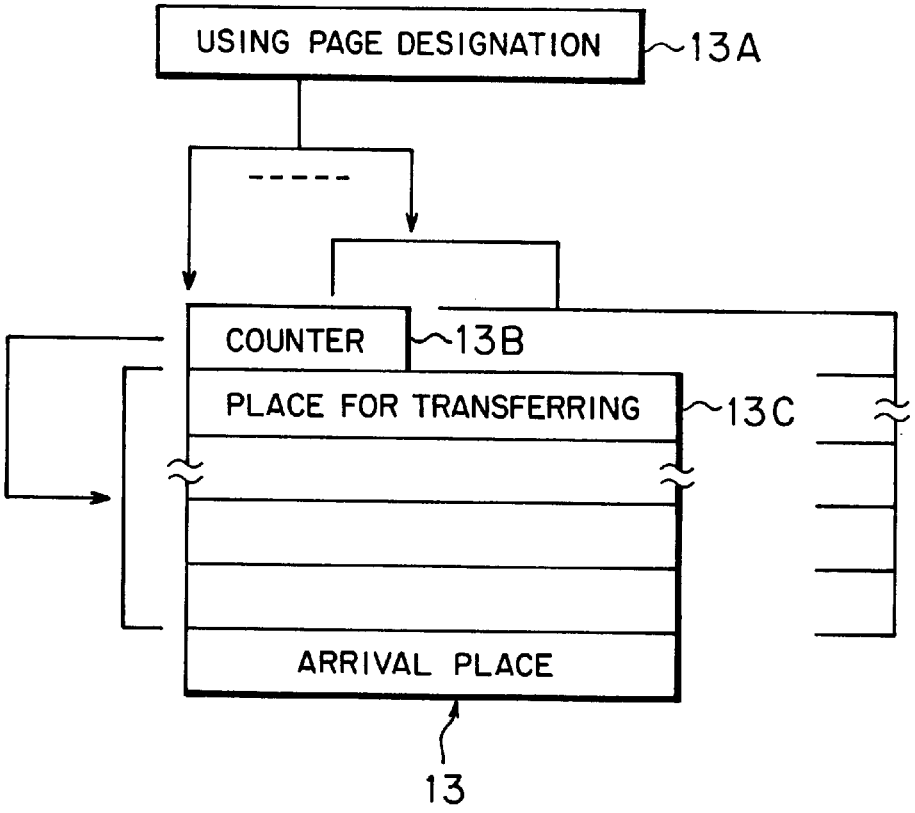
FIG. 3 is a diagram showing a structure of a transfer/arrival position table.

Here, the transfer/arrival position table 13 has, as shown in FIG. 3, for example, a using page designation table 13A, a count value (counter) 13B and a table 13C.

In the table 13C, there is registered position information relating to plural sets of a place for transferring/a destination according to a destination of a move or a using route of the user utilizing public transport facilities, with the count value 13B as page information.

The using page designation table 13A stores the page information (a count value) in the table 13C as position information of a place for transferring/a destination designated by the user at the time of operation, as will be described later. Incidentally, the page information stored in the using page designation table 13A is pointed at a corresponding count value 13B in the table 13C.

The transfer/arrival position confirming unit 14 extracts a positional relation between the present position and a place for transferring/arrival by referring to the transfer/destination position table 13 on the basis of present position detection information detected by the present position detecting unit 12B of the position information reading unit 12, which functions as the positional relation extracting unit.

Namely, the transfer/arrival position confirming unit 14 extracts a positional relation between the present position and a place for transferring/a destination by referring to a page designated in the table 13C of the transfer/arrival position table 13 so as to confirm whether or not the present position is a transfer position (a place for transferring) or an arrival position (a destination).

The notifying unit 15 displays a positional relation between the present position information recognized by the position information reading unit 12 and a place for transferring/a destination in public transportation facilities in a state of work operation, thereby notifying of it as transfer/arrival precaution information (transfer or arrival precaution information).

In concrete, the notifying unit 15 displays the above positional relation extracted by the transfer/arrival position confirming unit 14 as the transfer/arrival precaution notice (the transfer/arrival precaution information) by interrupting a state of another work of the information processing apparatus 10, thereby notifying the user that the user arrives at a place for transferring/a destination, which functions as the displaying unit.

When the user suspends the work in order to get off the vehicle when arriving at the place for transferring/the destination, the notifying unit 15 displays a window for memorandum on a display (not shown in FIG. 2) of the information processing apparatus 10 so that the user resumes the work in the next occasion, which functions as the memorandum window displaying unit.

In the information processing apparatus 10 shown in FIG. 2, there is provided a mode setting unit 16 for setting a mode of displaying transfer/arrival precaution notice or whether the window for memorandum is displayed or not in, for example, the notifying unit 15.

The display modes set by the mode setting unit 16 are as follows:

(1) mode of displaying transfer/arrival precaution notice on the display;

namely, transfer/arrival precaution notice is displayed in a window, a dialogue, a task bar, etc., or displayed as an animation;

(2) mode of displaying transfer/arrival precaution notice by sounds;

(3) mode of displaying transfer/arrival precaution notice by vibration;

namely, transfer/arrival precaution notice is displayed by vibrating a pointing device such as a track ball, or a bottom surface, a keyboard or the like of the information processing apparatus 10;

(4) mode of whether or not the window for memorandum is displayed when the user suspends the work.

Contents of such setting are held in a mode setting table 16A in the mode setting unit 16.

In concrete, the mode setting table 16A is configured with "mode setting value", "changed attribute at the time of transfer (attribute changed at the time of transfer)" and "changed attribute at the time of arrival (attribute changed at the time of arrival)", as shown in FIG. 4.

The above "mode setting value" is configured with a flag for setting the above-mentioned modes (1) through (4).

The "changed attribute at the time of transfer" mentioned above is configured with a flag for increasing a size of the display as a positional relation between the present position and a place for transferring gets closer.

Namely, the "changed attribute at the time of transfer" is to set a strength of the transfer precaution notice such that a window of the transfer precaution notice or characters of the transfer precaution notice displayed in the window is made larger as the place for transferring gets closer if the transfer precaution notice is displayed on the display, or sounds for the transfer previous notice is made louder as the place for transferring gets closer if the transfer previous notice is displayed by sounds.

Further, the "changed attribute at the time of arrival" is configured with a flag for increasing a size of the display as a positional relation between the present position and a destination gets closer, similarly to the above "changed attribute at the time of transfer". Incidentally, the "changed attribute at the time of arrival" is used when it is desired to control a notice at the time of transfer and a notice at the time of arrival in different manners. If the same control is used for the both, the changed attribute at the time of arrival may be the same as the changed attribute at the time of transfer.

According to set contents held in the mode setting table 16A, contents of a process in the notifying unit 15 is determined. In concrete, a process agreeing with mode setting according to a mode setting value is performed, and at the same time, a control of a display size of the window, or characters displayed in the window or a control of a volume of the sounds is performed according to the changed attribute at the time of transfer/changed attribute at the time of arrival.

The geostationary satellite 18 relays transmittance and reception of signals between the information processing apparatus 10 and the position analyzing apparatus 19. When receiving a position detecting signal from the signal transmitting unit 11 of the information processing apparatus 10, the geostationary satellite 18 extracts coordinates of the present position of the information processing apparatus 10 (a position in which a user of the information processing apparatus 10 actually exists) and transmits them to the position analyzing apparatus 19, besides transmitting a signal obtained as a result of the analysis by the position analyzing apparatus 19 to the position information reading unit 12 of the information processing apparatus 10.

When receiving present position coordinates information from the geostationary satellite 18, the position analyzing apparatus 19 specifies the present position of the information processing apparatus 10 on the basis of the coordinates information, generates a signal for detecting the present position (the nearest station/place), and transmits it to the geostationary satellite 18. The position analyzing apparatus 19 can be configured with a system such as a computer or the like.

Actually, in the information processing apparatus 10 according to the first embodiment, a function corresponding to the signal transmitting unit 11, the position information reading unit 12, the transfer/arrival position confirming unit 14, the notifying unit 15 and the mode setting unit 16 mentioned above is realized as an operation of a processor circuit (a CPU or the like) not shown by reading out a program [hereinafter, referred as a transfer/arrival precaution notifying program (transfer or arrival precaution notifying program)] recorded in a record medium (not shown) such as a disk apparatus, a CD-ROM, or the like in the computer to a memory (RAM) not shown, activating the program and executing the program by the processor circuit.

The transfer/arrival precaution notifying program makes the computer function, as a receiving-recognizing means (corresponding to the position information reading unit 12) which receives information for recognizing the present position during a move to a place for transferring/a destination as a radio signal from the outside to recognize the present position during the move from the received signal, and a notifying means (corresponding to the notifying unit 15) which displays a positional relation between the present position information recognized by the receiving-recognizing means and the place for transferring/the destination in the public transport facilities in a state of work operation, thereby notifying of it as the transfer/arrival precaution information.

In concrete, the transfer/arrival precaution notifying program makes the computer function, as a signal transmitting means (corresponding to the signal transmitting unit 11) which transmits a position detecting signal for showing coordinates of the information processing apparatus 10 to the signal position analyzing unit 19 via the geostationary satellite 18, a signal receiving means (corresponding to the signal receiving unit 12A) which receives a signal for detecting the present position during a move from the geostationary satellite 18 while the information processing apparatus 10 moves to a place for transferring/a destination, a present position information detecting means (corresponding to the present position detecting unit 12B) which detects the present position during the move on the basis of the received signal from the signal receiving means, a transfer/arrival position confirming means (corresponding to the transfer/arrival position confirming unit 14) which extracts a positional relation between the present position and the place for transferring/the destination by referring to the transfer/arrival position table 13 on the basis of present position detection information detected by the present position information detecting means, a notifying means (corresponding to the notifying unit 15) which displays the positional relation between the present position information recognized by the position information reading unit 12 and the place for transferring/the destination in the public transport facilities in a state of work operation, thereby notifying of it as transfer/arrival precaution information [more concretely, interrupts a state of another work in the information processing apparatus 10 to display the positional relation extracted by the transfer/arrival position confirming means as transfer/arrival precaution notice (transfer/arrival precaution information), thereby notifying a user of the information processing apparatus 10 that the user arrives at the place for transferring/the destination], a memorandum window displaying means (corresponding to the notifying unit 15) which displays a window for memorandum on a display (not shown) of the information processing apparatus 10 when the user of the information processing apparatus 10 suspends the work and gets out from the vehicle at the place for transferring/the destination in order to record memorandum information to be used when the user resumes the work in the next occasion, and a mode setting means (corresponding to the mode setting unit 16) which sets a mode of display of the transfer/arrival precaution notice by the notifying means, or sets whether or not the window for memorandum is displayed by the memorandum window displaying means.

The transfer/arrival precaution notifying program is recorded in, for example, a CD-ROM, and is installed from the CD-ROM or the like to a disk apparatus or the like of the computer (the information processing apparatus 10) to be used. The transfer/arrival precaution notifying program may be directly read out from, for example, a CD-ROM, without being installed in the disk apparatus or the like of the computer (the information processing apparatus 10).

The above-mentioned disk apparatus or CD-ROM is a computer readable record medium in which the transfer/arrival precaution notifying program for operating the computer that the user can carry and work with it while moving to a place for transferring/a destination utilizing public transport facilities is recorded.

The transfer/arrival position table 13 and the mode setting table 16A are recorded in a record medium (not shown) such as a disk apparatus or the like, and read out to a memory (RAM) not shown to be used.

In the information processing apparatus 10 with a transfer/arrival precaution notifying function having the above structure according to the first embodiment, the present position during a move is recognized when a user of the information processing apparatus 10 works with it during the move to a place for transferring/a destination utilizing public transport facilities, and a positional relation between the present position and the place for transferring/the destination set in advance (showing whether or not the present position is the place for transferring/the destination) is displayed by interrupting a state of another work.

In the information processing apparatus 10, when a signal for detecting the present position during a move is received from the geostationary satellite 18 (the position detecting signal receiving step), the present position during the move is detected on the basis of the received signal (the present position information detecting step).

A positional relation between the detected present position and a place for transferring/a destination set in advance in each information processing apparatus 10 is then extracted (the positional relation extracting step), and the extracted positional relation is displayed as the transfer/arrival precaution information by interrupting a state of another work (the displaying step).

An operation of the information processing apparatus 10 and operations of the geostationary satellite 18 and the position analyzing apparatus 19 at this time will be described in detail with reference to flowcharts shown in FIGS. 5 through 11.

In the information processing apparatus 10, a registering process in the transfer/arrival position table 13 is conducted prior to use of the transfer/arrival precaution notifying function so that setting of a page of a place for transferring/a destination, inputting of the number of places for transferring and the places for transferring and inputting of a destination are performed.

Figure 5:
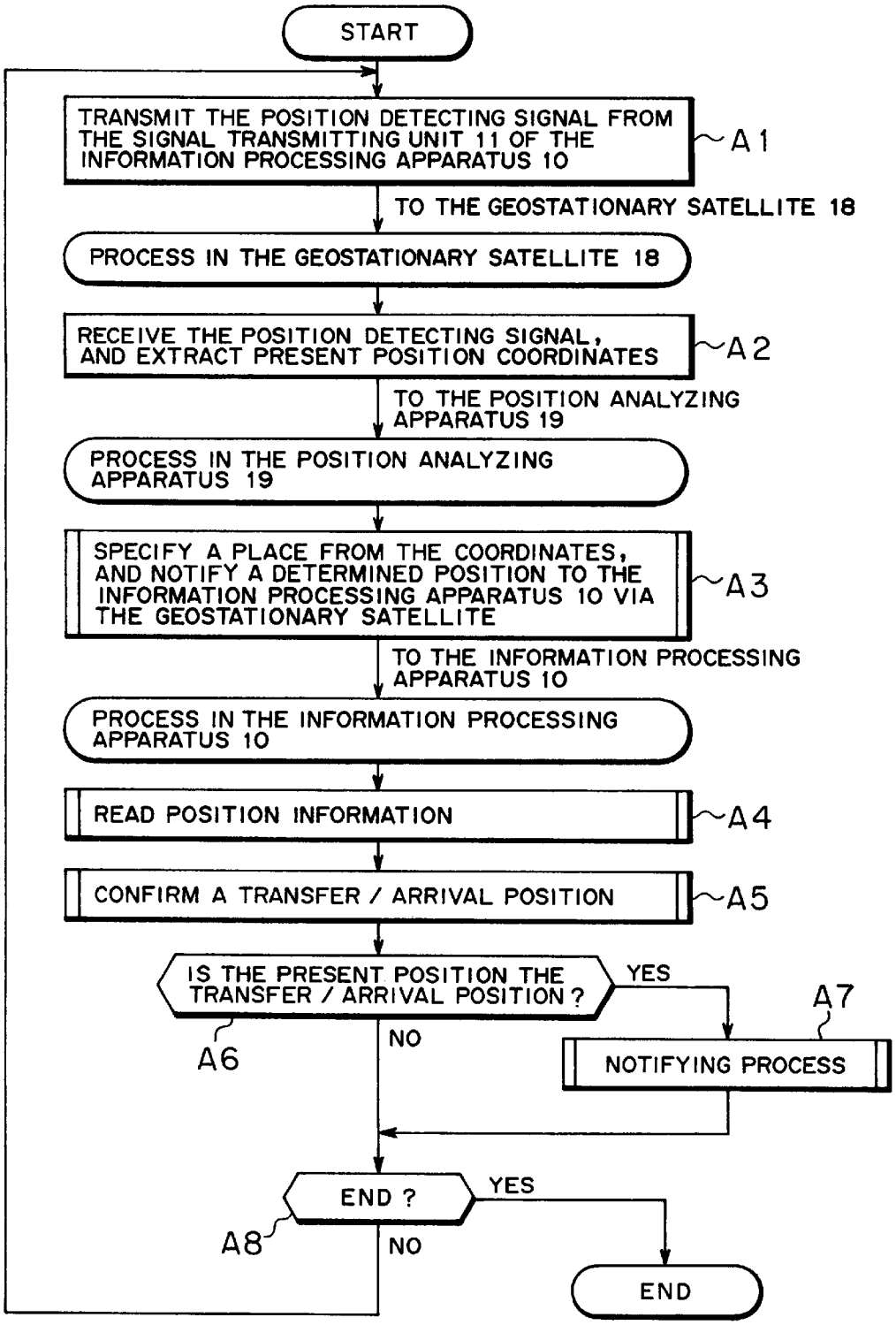
FIGS. 5 through 11 are flowcharts for illustrating operations of the transfer/arrival precaution notifying system to which the information processing apparatus with a transfer/arrival precaution notifying function according to the first embodiment of this invention is applied.

In the information processing apparatus 10, the signal transmitting unit 11 transmits the position detecting signal for showing coordinates of the information processing apparatus 10 to the geostationary satellite 18 (Step A1 in FIG. 5).

Following that, the geostationary satellite 18 extracts coordinates of the present position of the information processing apparatus 10 when receiving the position detecting signal from the signal transmitting unit 11, and transmits them to the position analyzing apparatus 19 (Step A2 in FIG. 5).

Figure 6:
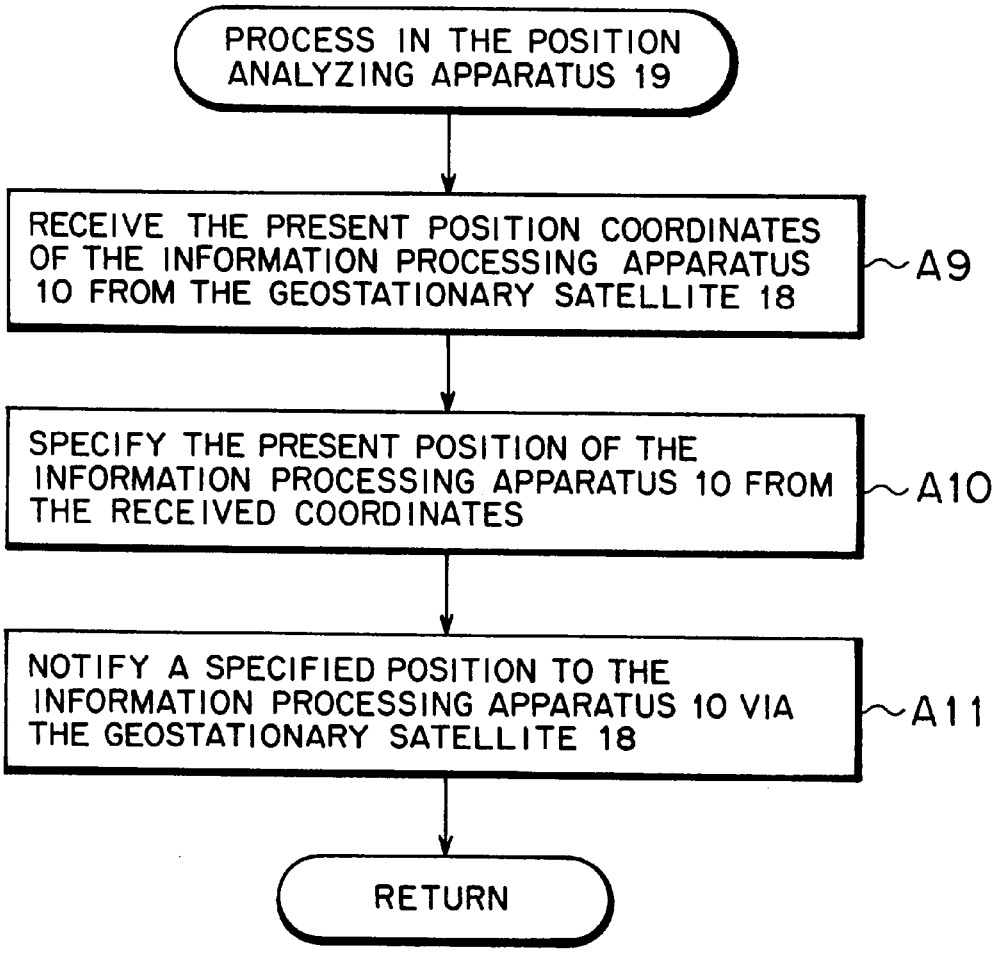

When receiving present position coordinates information from the geostationary satellite 18 (Step A9 in FIG. 6), the position analyzing apparatus 19 specifies the present position of the information processing apparatus 10 (a position in which a user of the information processing apparatus 10 actually exists) on the basis of the coordinates information (Step A10 in FIG. 6), and transmits it as a signal for detecting the present position (the nearest station/place) to the information processing apparatus 10 via the geostationary satellite 18 (Step A11 in FIG. 6; that is, the above Steps A9 through A11 correspond to the Step A3 in FIG. 5).

The information processing apparatus 10 receives the signal from the position analyzing apparatus 19 by the signal receiving unit 12A of the position information reading unit 12, and reads position information (Step A4 in FIG. 5).

Figure 7:
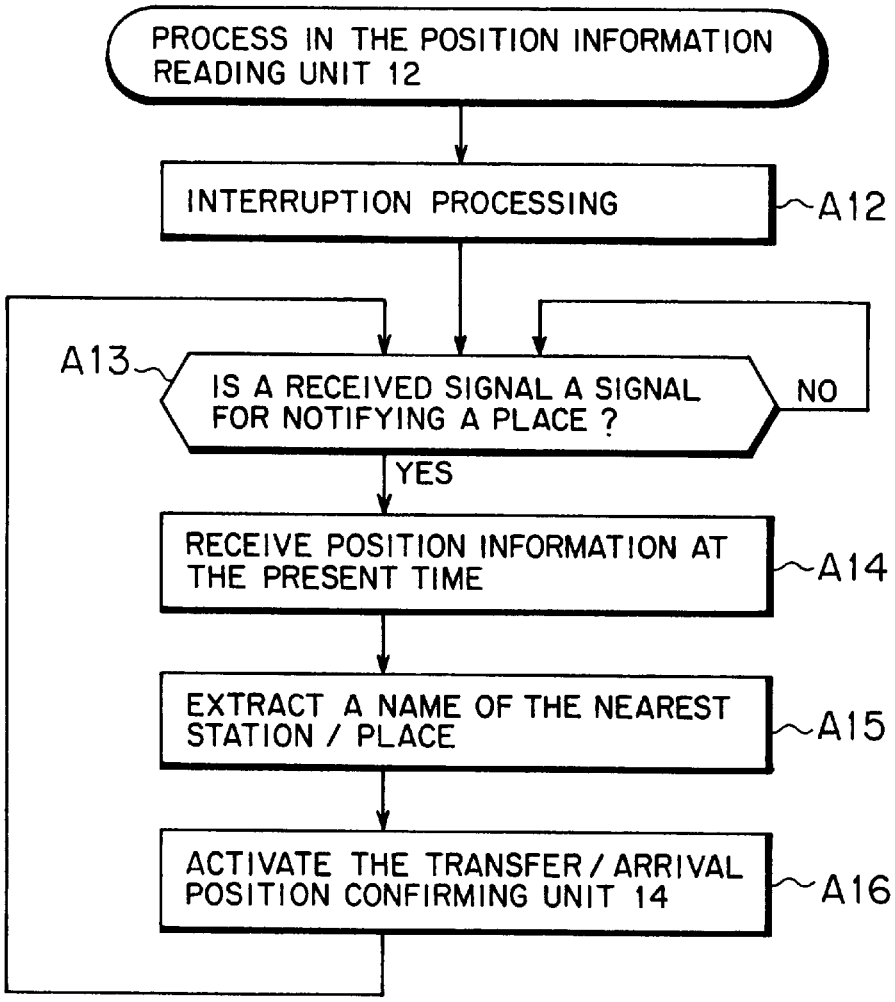

When the information processing apparatus 10 receives the signal from the position analyzing apparatus 19, an interruption processing is generated in the position information reading unit 12 (Step A12 in FIG. 7), so that it is determined by the position information reading unit 12 whether or not the received signal is a signal from the position analyzing apparatus 19 (a signal for notifying a place) (Step A13 in FIG. 7).

When it is determined that the received signal is from the position analyzing apparatus 19 (YES route at the above Step A13), the position information reading unit 12 receives place information of the actual present position (at the present time) from the signal (Step A14 in FIG. 7), extracts the present position (a name of the nearest station/place) during the move on the basis of the received signal from the signal receiving unit 12A (Step A15 in FIG. 7), and notifies the transfer/arrival position confirming unit 14 of it, whereby the transfer/arrival position confirming unit 14 is activated (Step A16 in FIG. 7).

Further, the transfer/arrival position confirming unit 14 confirms a transfer/arrival position (Steps A5 and A6 in FIG. 5).

In the transfer/arrival position confirming unit 14, it is determined whether or not the transfer/arrival precaution notifying function is started to be used. In other words, when receiving the notice from the position information reading unit 12, the transfer/arrival position confirming unit 14 determines that the transfer/arrival precaution notifying function is started to be used. If not, the transfer/arrival position confirming unit 14 repeats determination as to whether or not the transfer/arrival precaution notifying function is started to be used (Step A17 in FIG. 8).

Figure 8:
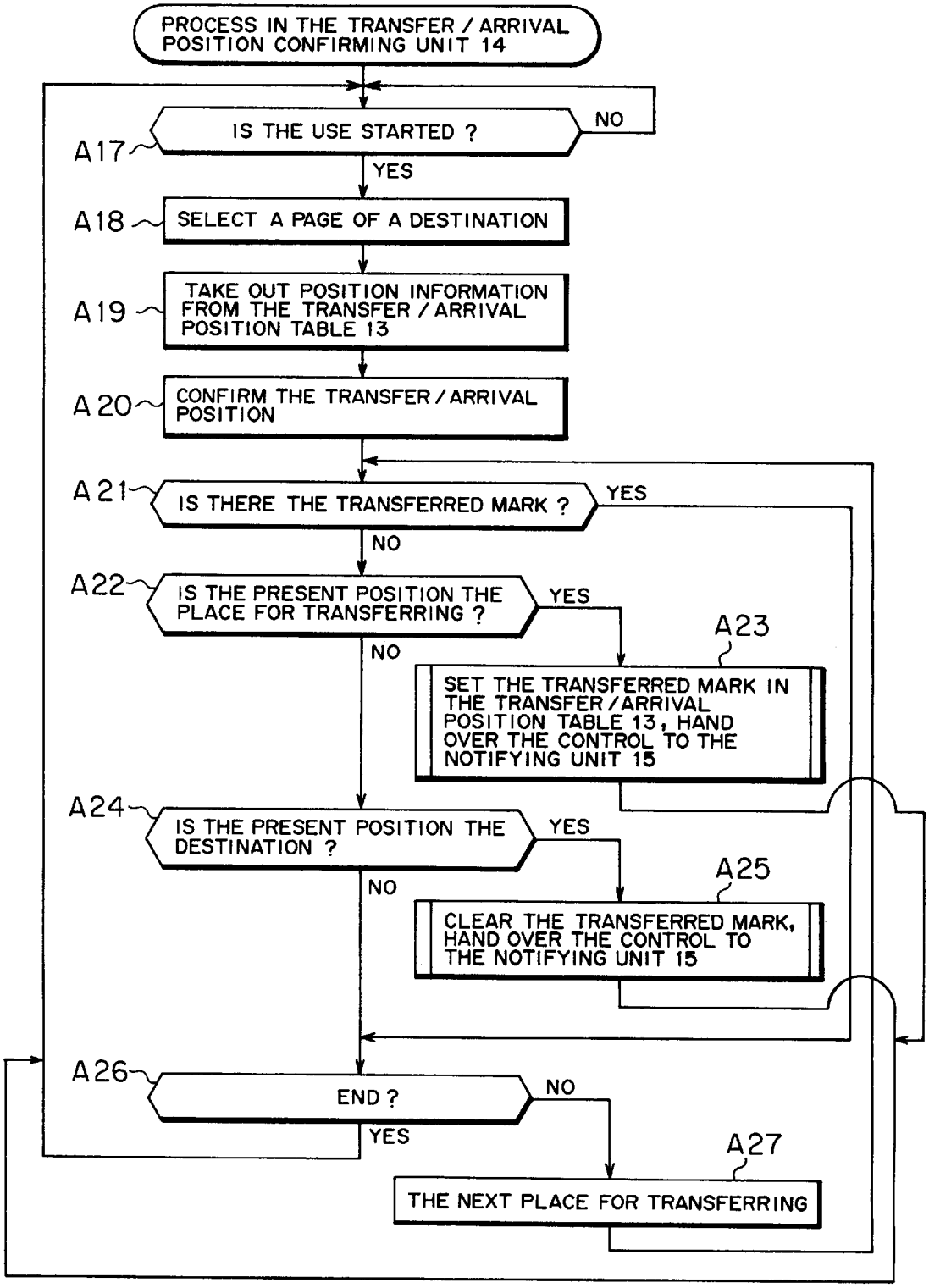

When receiving the notice from the position information reading unit 12, the transfer/arrival position confirming unit 14 selects a page of a destination in the transfer/arrival position table 13 (Step A18 in FIG. 8), takes out position information relating to a place for transferring/a destination from the transfer/arrival position table 13 (Step A19 in FIG. 8), and starts confirmation of a transfer/arrival position (Step A20 in FIG. 8).

At this time, it is determined if there is a transferred mark showing that the user has already arrived at a place for transferring and has transferred in the position information taken out from the transfer/arrival position table 13 (Step A21 in FIG. 8).

If determining that there is no transferred mark (NO route at the above Step A21), the transfer/arrival position confirming unit 14 determines that the name of the nearest station/place extracted by the position information reading unit 12 (refer to Step A15 in FIG. 7) is the place for transferring shown in the transfer/arrival position table 13 (Step A22 in FIG. 8). If determining that the nearest station/place is a place for transferring (YES route at the above Step A22), the transfer/arrival position confirming unit 14 sets the transferred mark in the transfer/arrival position table 13, after that, hands over a control to the notifying unit 15 in order to notify the user of transfer precaution (Step A23 in FIG. 8).

If determining that the nearest station/place is not a place for transferring (NO route at the above Step A22), the transfer/arrival position confirming unit 14 determines whether or not a name of the nearest station/place is a destination shown in the transfer/arrival position table 13 (Step A24 in FIG. 8). If determining that the nearest station/place is a destination (YES route at the above Step A24), the transfer/arrival position confirming unit 14 deletes the transferred mark in the transfer/arrival position table 13 in preparation for the next use, and hands over the control to the notifying unit 15 in order to notify the user of arrival precaution (Step A25 in FIG. 8).

If determining that there is the transferred mark at the above Step A21 (YES route at the above Step A21), and if determining that the nearest station/place is not the destination at the above Step A24 (NO route at the above Step A24), the transfer/arrival position confirming unit 14 determines whether or not confirmation of the transfer/arrival position is terminated (Step A26 in FIG. 8).

If a plurality of places for transferring are set in the transfer/arrival position table 13, the transfer/arrival position confirming unit 14 sets an object of the confirmation to the next place for transferring (from NO route at the above Step A26 to Step A27 in FIG. 8), and continues the confirmation of the place for transferring/the destination (from the above Step A27 to Step A21).

If the information processing apparatus 10 does not yet arrive at the place for transferring/the destination, the operation at and after the above Step A17 is repeated (from YES route at the above A26 to the above Step A17).

When the notifying unit 15 receives the control from the transfer/arrival position confirming unit 14, the notifying unit 15 notifies the user of transfer/arrival precaution (Step A7 in FIG. 5).

Figure 9:
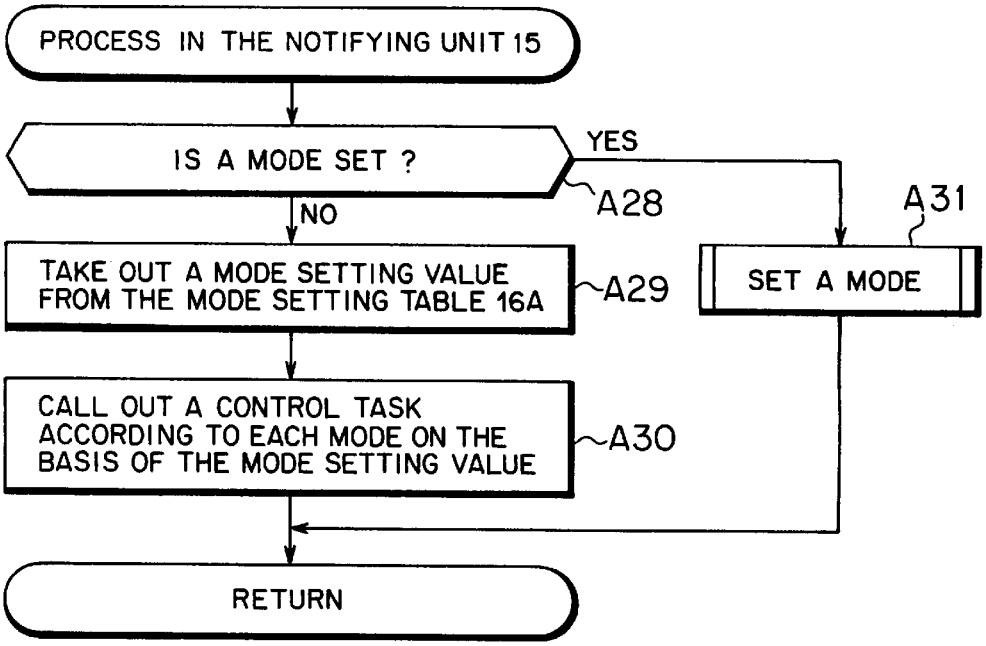

Namely, the notifying unit 15 first determines whether or not a mode is set (Step A28 in FIG. 9). If the notifying unit 15 does not set a mode but notifies, the notifying unit 15 takes out a mode setting value from the mode setting table 16A (from NO route at the above Step A28 to Step A29 in FIG. 9), and calls out a control task corresponding to each mode on the basis of the mode setting value (Step A30 in FIG. 9).

Figure 12:
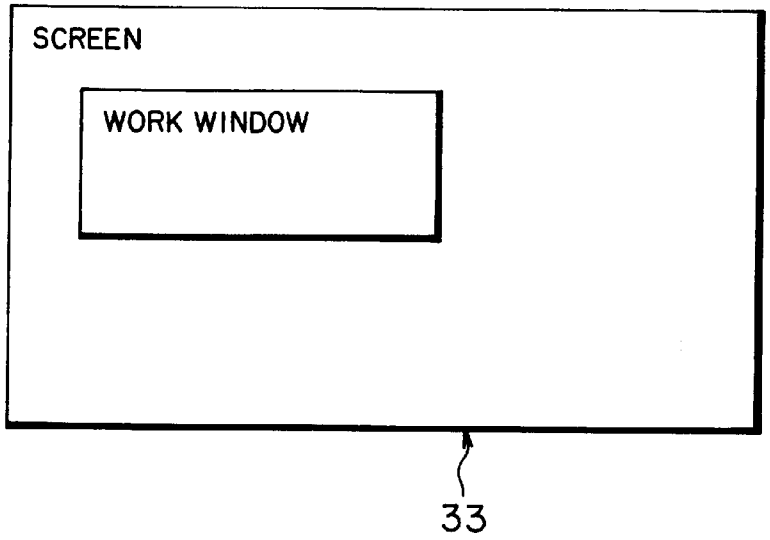
FIGS. 12(*a*), 12(*b*), 13(*a*), 13(*b*), 14, 15(*a*), 15(*b*), 16(*a*), 16(*b*), 17(*a*) and 17(*b*) are diagrams showing displaying states of a display of the information processing apparatus with a transfer/arrival precaution notifying function according to the first embodiment of this invention.
Figure 12:
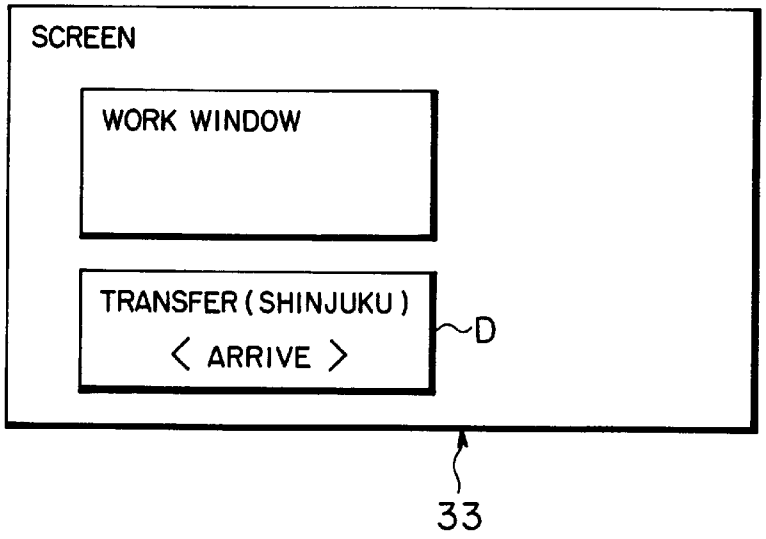
Figure 17A:
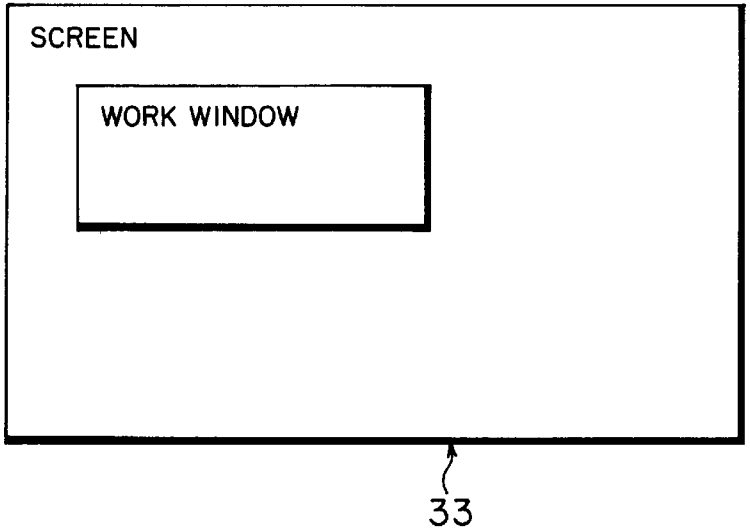
Figure 17B:
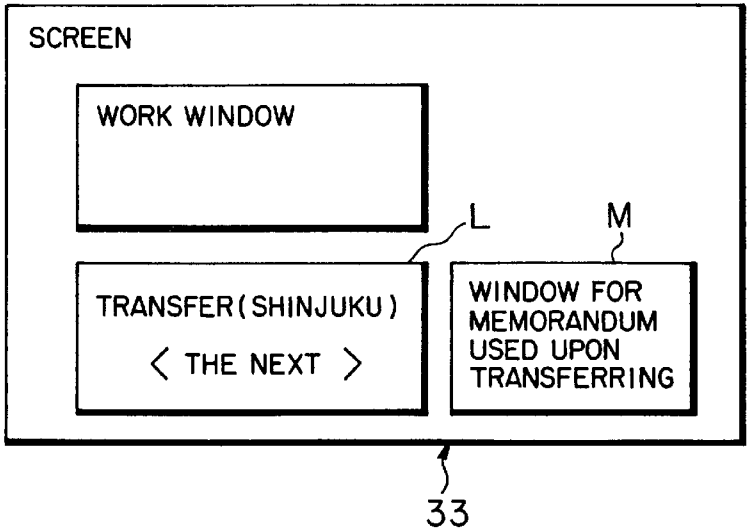

In the case of a mode in which a window is opened and transfer/arrival precaution is notified, the transfer/arrival precaution is notified in a form of window when the user of the information processing apparatus 10 arrives at the place for transferring/the destination (Step A32 in FIG. 10), as shown by a reference character D in FIG. 12(*b*). Incidentally, FIG. 12(*a*) shows a state of display of a display 33 of the information processing apparatus 10 before the notice. The notifying unit 15 determines whether or not the mode setting value represents a mode of displaying the window for memorandum (Step A33 in FIG. 10). If the notifying unit 15 determines that the mode setting value represents a mode of displaying the window for memorandum (YES route at the above Step A33), the transfer/arrival precaution is displayed in a form of window, besides a window M for memorandum is displayed (Step A36 in FIG. 10), as shown by a reference character L in FIG. 17(*b*). Incidentally, FIG. 17(*a*) shows a state of display of the display 33 of the information processing apparatus 10 before the notice and the display of the window for memorandum.

Figure 10:
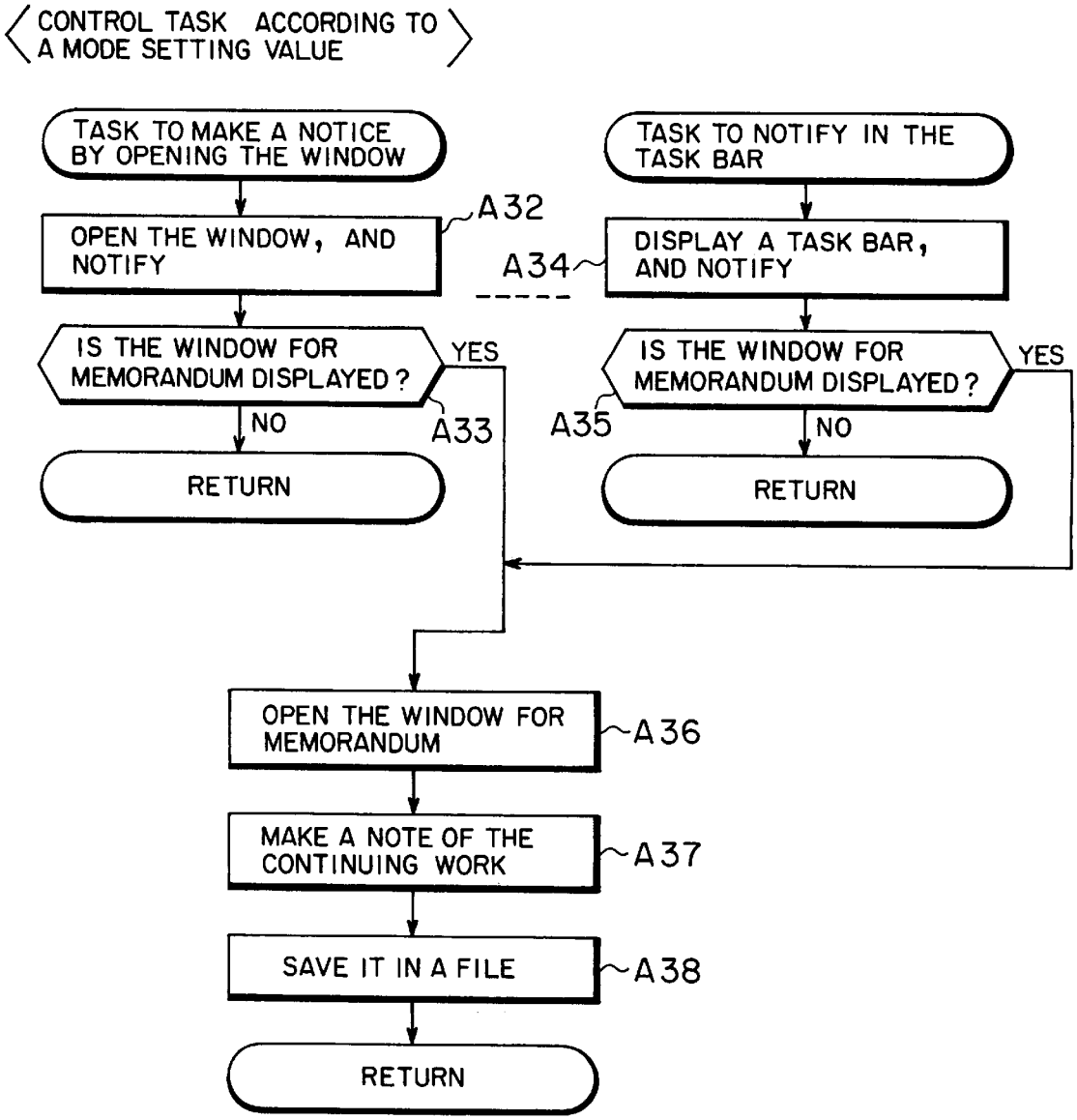

After that, the user of the information processing apparatus 10 makes a note in the window for memorandum (Step A37 in FIG. 10), and contents of the note are saved (Step A38 in FIG. 10).

Figure 14:
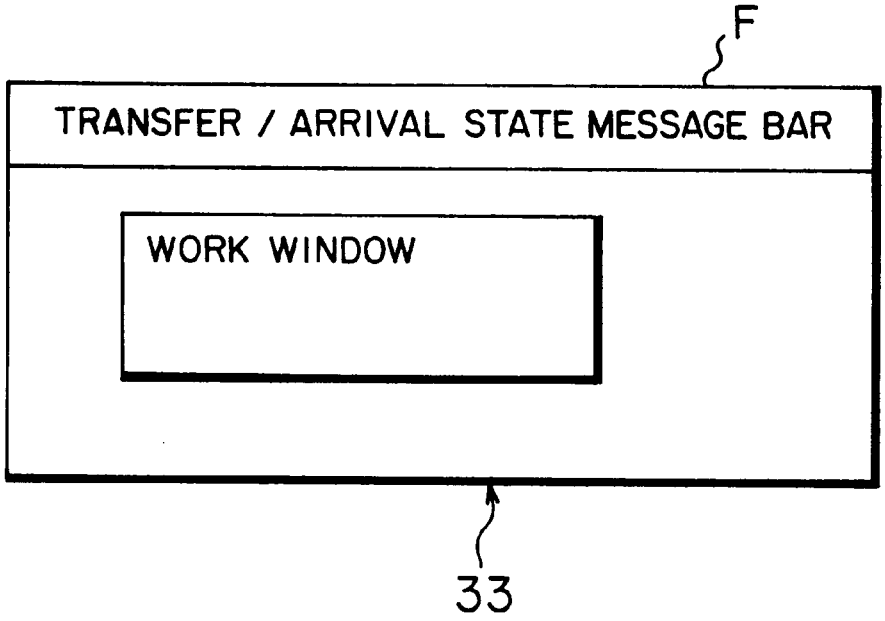

In the case of a mode in which the transfer/arrival precaution is notified in a task bar, the transfer/arrival precaution is notified in the task bar when the user arrives at the place for transferring/the destination, as shown by a reference character F in FIG. 14 (Step A34 in FIG. 10).

In this case, it is also determined whether or not the mode setting value represents a mode of displaying the window for memorandum (Step A35 in FIG. 10). In the case of a mode of displaying the window for memorandum (YES route at the above Step A35), the window for memorandum is displayed, and contents of a memorandum described in the window for memorandum are saved (from Step A36 to Step A38 in FIG. 10).

Figure 13A:
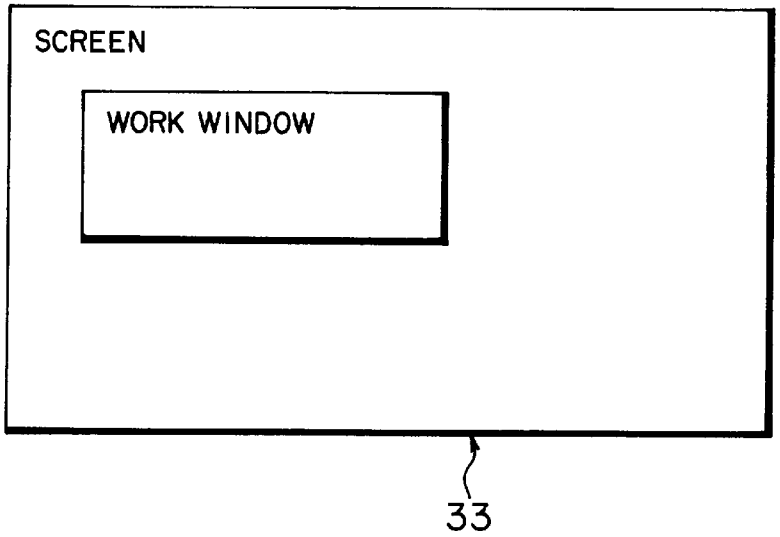
Figure 13B:
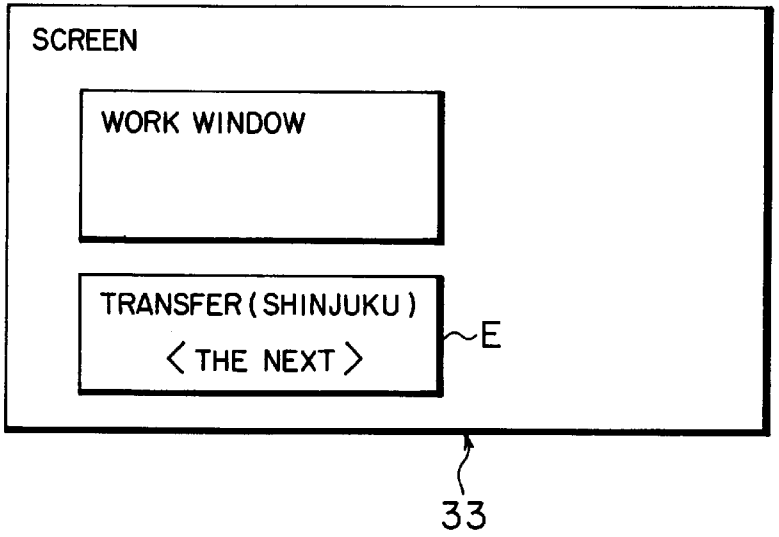

Meanwhile, it is alternatively possible to notify the user that the next station/place is the place for transferring/the destination when the user arrives at a station/place one station/place this side of the place for transferring/the destination, as shown by a reference character E in FIG. 13(*b*). In which case, there is added a procedure of determining that the next station/place is the place for transferring/the destination from the present time and a direction of travel and notifying of it. Incidentally, FIG. 13(*a*) shows a state of display of the display 33 of the information processing apparatus 10 before the notice.

Figure 15A:
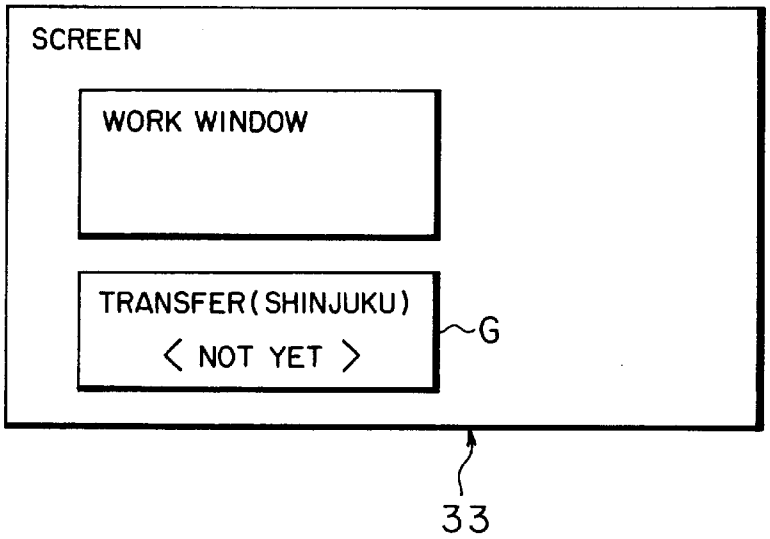
Figure 15B:
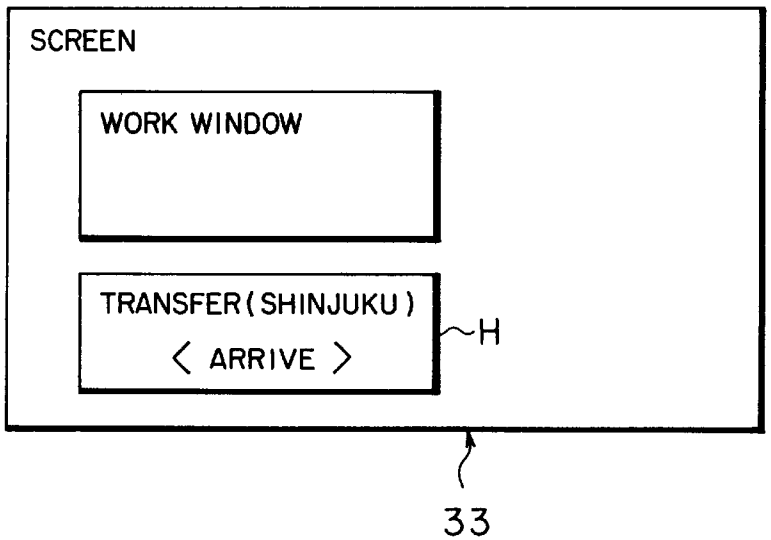
Figure 16A:
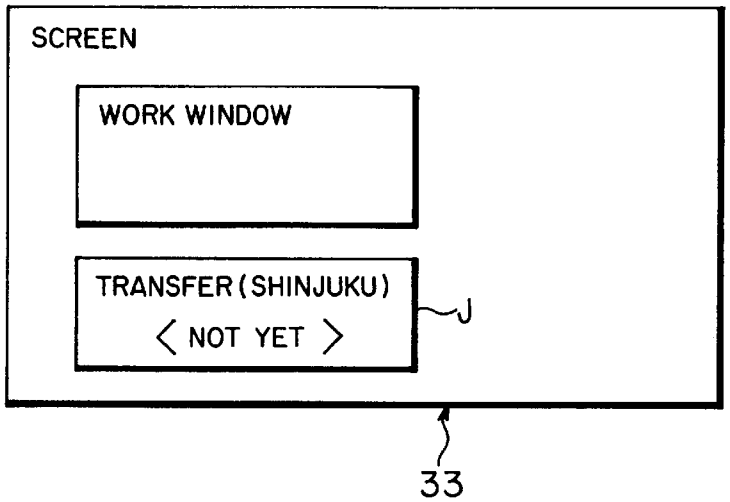
Figure 16B:
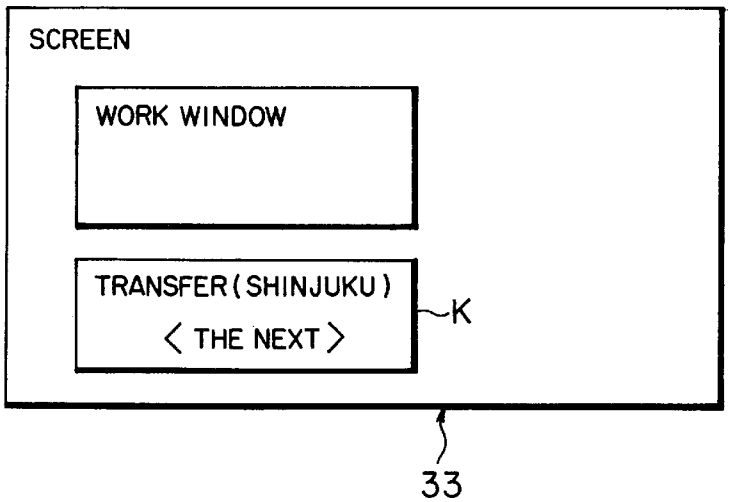

Further, it is possible to always display a window showing whether or not the present position is the place for transferring/the destination on the display 33 of the information processing apparatus 10, as shown by reference characters G, H, J and K in FIGS. 15(*a*), 15(*b*), 16(*a*) and 16(*b*), respectively.

Figure 11:
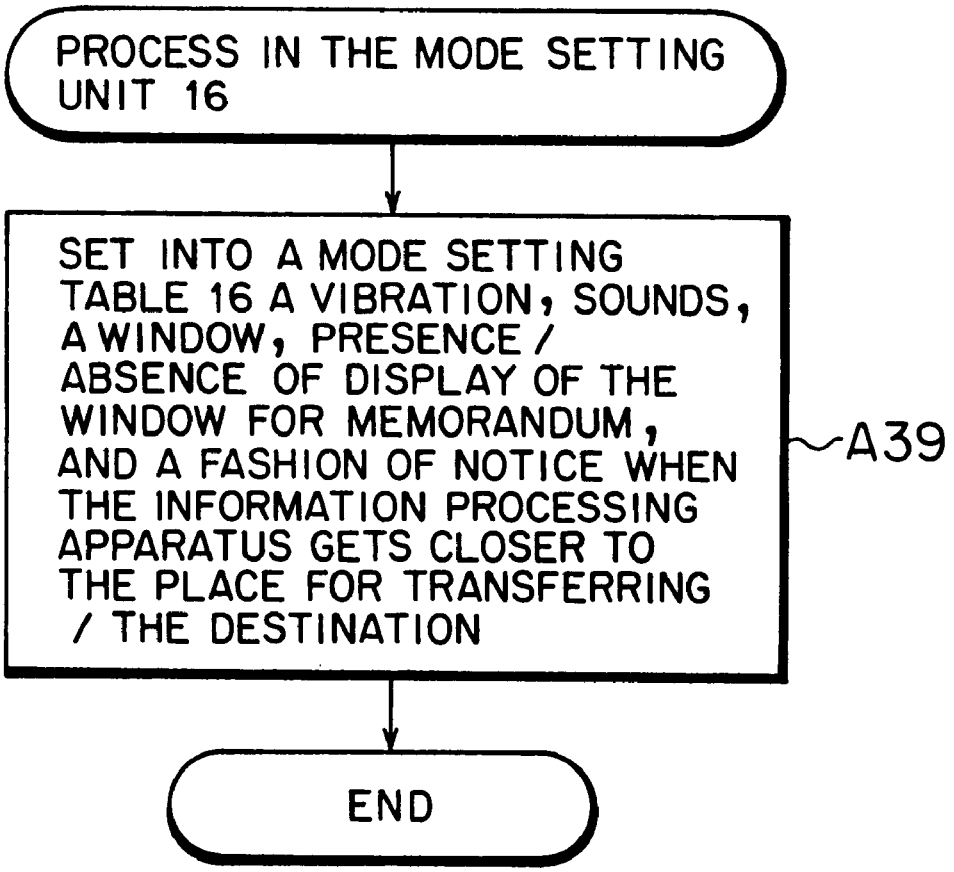

If it is determined that a mode setting is performed at Step A28 in FIG. 9 (YES route at the above Step A28), the mode setting unit 16 sets contents of various settings into the mode setting table 16A (Step A31 in FIG. 9; that is, Step A39 in FIG. 11).

Finally, the notifying unit 15 determines whether or not use of the transfer/arrival precaution notifying function is terminated (Step A8 in FIG. 5). If the use of the transfer/arrival precaution notifying function is terminated, the procedure proceeds to a YES route at the above Step A8. If not, the procedure returns from a NO route at the above Step A8 to the process at and after Step A1.

The information processing apparatus 10 with a transfer/arrival precaution notifying function according to the first embodiment of this invention displays a positional relation between the present position of the information processing apparatus 10 and a place for transferring/a destination in public transport facilities by interrupting a state of another work in the information processing apparatus 10, so that a user of the information processing apparatus 10 does not need to always pay regard to whether the user arrives at the place for transferring/the destination even if the user works with the information processing apparatus 10 while moving in public transport facilities. Therefore, it is possible for the user to avoid riding past and concentrate on the work.

Particularly, the information processing apparatus 10 itself has the transfer/arrival precaution notifying function so that the user does not need to carry another apparatus separately from the information processing apparatus 10. In addition, the user can readily confirm on the display 33 whether or not the user arrives at a place for transferring/a destination while working with the information processing apparatus 10.

When notifying of the transfer/arrival precaution, the information processing apparatus 10 displays the window for memorandum at the same time, whereby the user describes a note and saves it. Even if the work is suspended because of transfer or the like, a time required to resume the suspended work may be minimized and continuity of the work may be kept.

Since various signals are transmitted and received via the geostationary satellite 18, it is possible to realize the transfer/arrival precaution notifying function without introducing an apparatus for transmitting/receiving signals in each line each time a new line is set up or the line is changed as described in the above-mentioned publications.

(b1) Description of Modification of the First Embodiment

Figure 18:
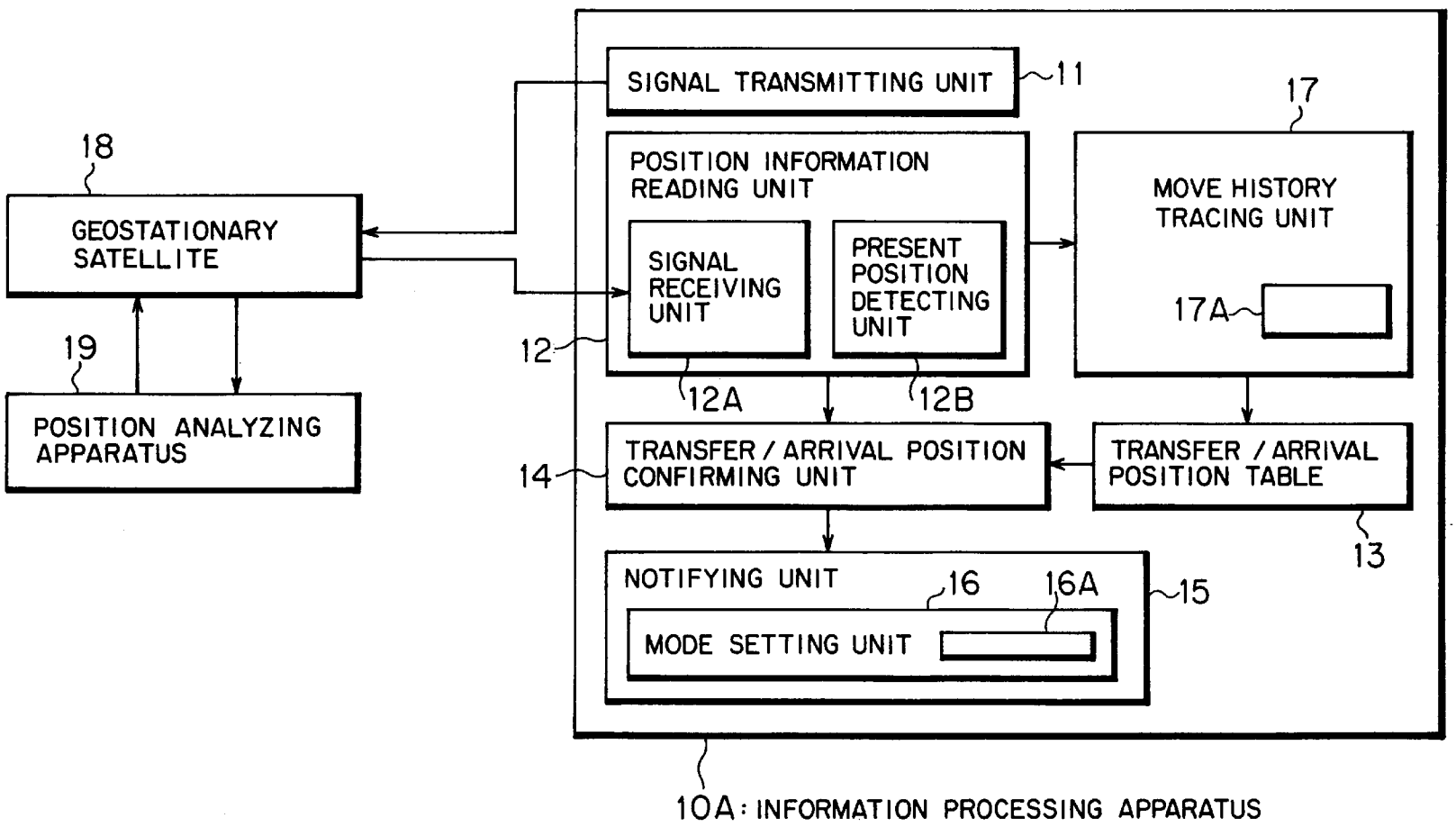
FIG. 18 is a block diagram showing the transfer/arrival precaution notifying system to which an information processing apparatus with a transfer/arrival precaution notifying function according to a modification of the first embodiment of this invention is applied.

FIG. 18 is a block diagram showing a transfer/arrival precaution notifying system to which an information processing apparatus with a transfer/arrival precaution notifying function according to a modification of the first embodiment of this invention is applied. The transfer/arrival precaution notifying system has an information processing apparatus 10A, a geostationary satellite 18 and a position analyzing apparatus 19.

The information processing apparatus 10A with the transfer/arrival precaution notifying function shown in FIG. 18 is carried by a user, with which the user can work while moving to a place for transferring/a destination utilizing public transport facilities. The information processing apparatus 10A has a function of notifying the user that the user arrives at a place for transferring/a destination, thus functioning as the information processing apparatus with a transfer or arrival precaution notifying function.

The information processing apparatus 10A according to the modification has a structure similar to that of the information processing apparatus 10 according to the first embodiment, excepting that the information processing apparatus 10A additionally has a move history tracing unit 17.

The move history tracing unit 17 traces a move history utilizing public transport facilities on the basis of present position information during a move from the present position detecting unit 12B of the position information reading unit 12.

The information processing apparatus 10A according to this modification uses a move history traced by the move history tracing unit 17 as register information of the transfer/arrival position table 13.

Namely, the move history tracing unit 17 traces the present position of the information processing apparatus 10A received by the present position detecting unit 12B, decides a place for transferring/a destination by considering a cycle of the traced move history, a width of coordinates of a range of the move, diagrams of the public transport facilities, etc., so as to automatically make the transfer/arrival position table 13.

The move history traced by the move history tracing unit 17 is stored in a move history trace table 17A.

Figure 19:
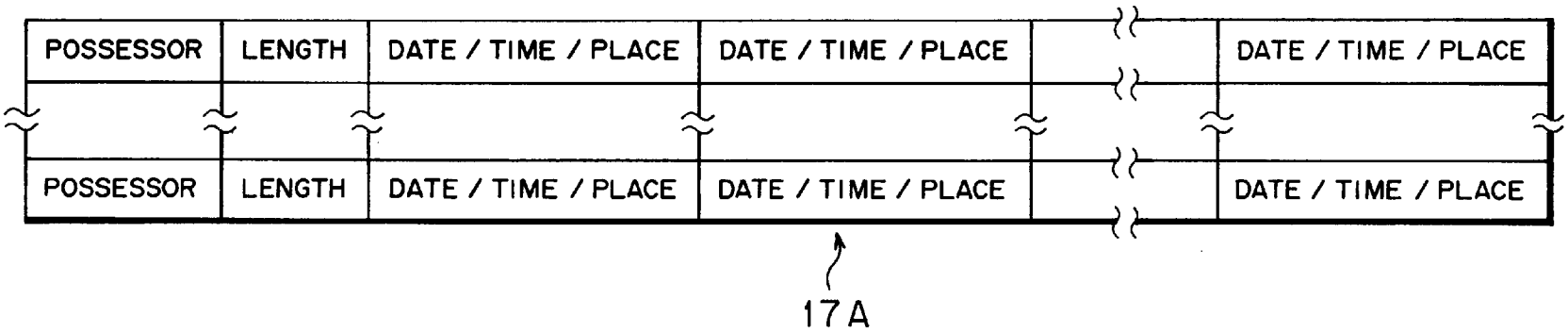
FIG. 19 is a diagram showing an example of a structure of a move history trace table.

The move history trace table 17A is configured with a possessor, a length, a date/time/place, in which a move history is stored in a corresponding part, as shown in FIG. 19, for example.

With the above structure, the information processing apparatus 10A according to the modification of the first embodiment recognizes the present position during a move when the user works while moving to a place for transferring/a destination utilizing public transport facilities, and displays a positional relation between the present position and the place for transferring/the destination set in advance (whether the present position is the place for transferring/the destination) by interrupting a state of another work, as well as the above-mentioned information processing apparatus 10 according to the first embodiment.

In the information processing apparatus 10A, the move history tracing unit 17 traces a move history prior to use of the transfer/arrival precaution notifying function, and automatically makes the transfer/arrival position table 13 on the basis of the traced move history.

Therefore, it becomes unnecessary that the user registers a moving route utilizing public transport facilities in the transfer/arrival position table 13 so that the operation can be simplified.

Figure 20:
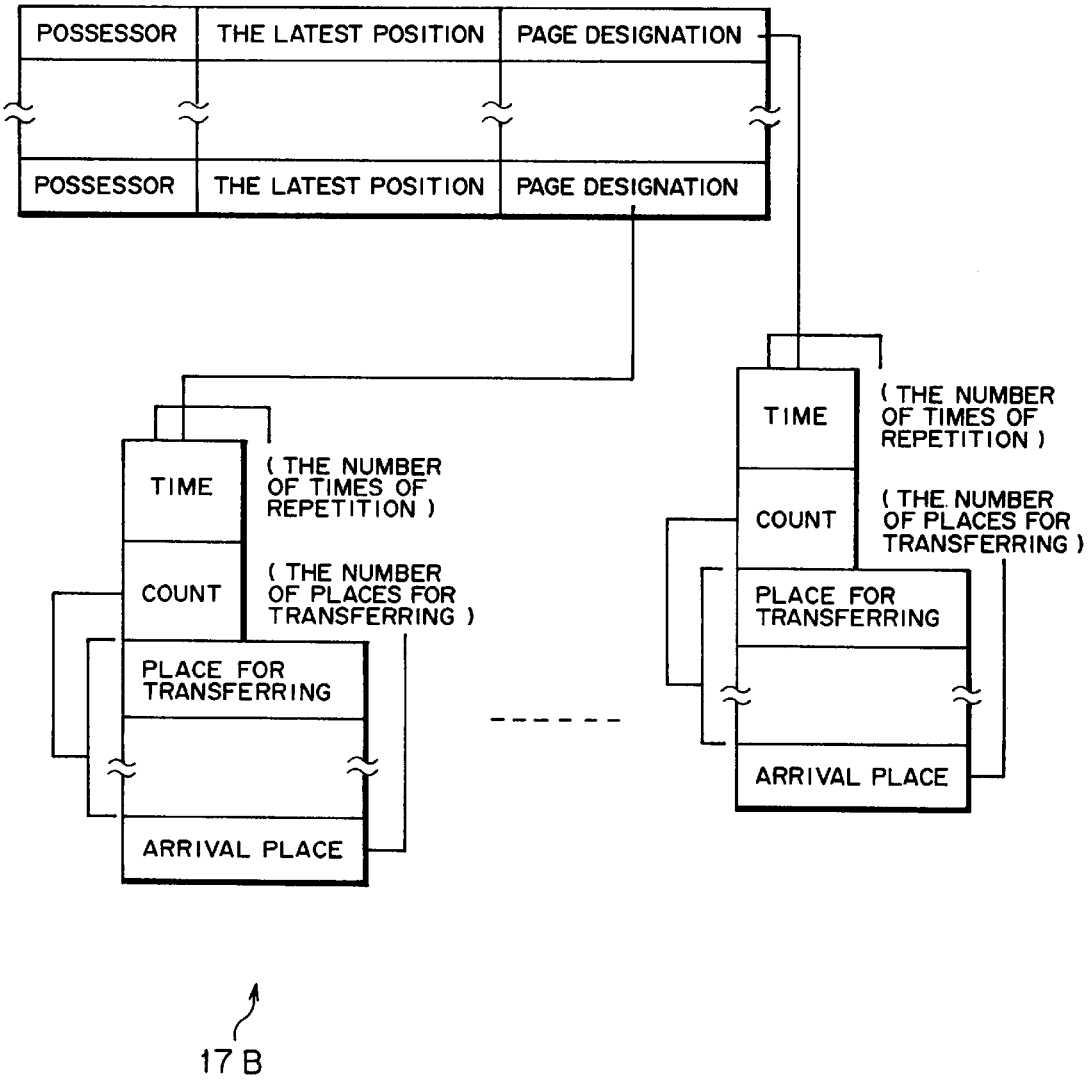
FIG. 20 is a diagram showing another example of the structure of the move history trace table.

As the move history trace table, it is possible to use a move trace table 17B as shown in FIG. 20, for example.

The move history trace table 17B is configured with a possessor, the latest position, repetition trace information (a moving route and the number of moves), in which a move history is stored in a corresponding part.

From the repetition trace information, it is possible to grasp a habit of using public transport facilities (that is, a habit of using such that the possessor takes a certain route to move from Monday to Friday, for example, but does not take that route on Saturday and Sunday). Whereby, the transfer/arrival position table 13 can be made from a habit of using public transport facilities and the transfer/arrival precaution can be notified according to the habit of using.

(c) Description of a Second Embodiment

Figure 21:
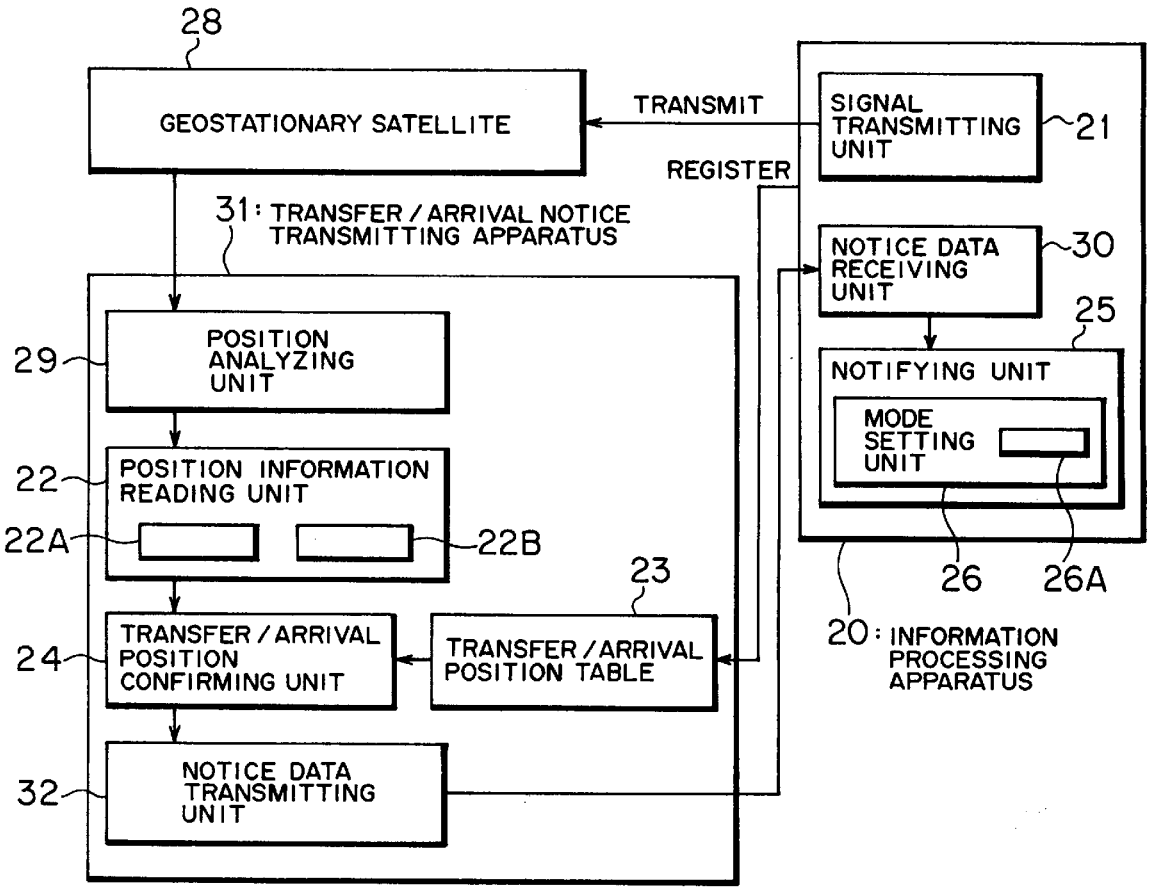
FIG. 21 is a block diagram showing a transfer/arrival precaution notifying system to which an information processing apparatus with a transfer/arrival precaution notifying function according to a second embodiment of this invention is applied.

FIG. 21 is a block diagram showing a transfer/arrival precaution notifying system to which an information processing apparatus with a transfer/arrival precaution notifying function according to a second embodiment of this invention is applied. The transfer/arrival precaution notifying system has an information processing apparatus 20, a geostationary satellite 28 and a transfer/arrival notice transmitting apparatus 31.

The information processing apparatus 20 with a transfer/arrival precaution notifying function shown in FIG. 21 is carried by a user, with which the user can work while moving to a place for transferring/a destination (a place for transferring or a destination) utilizing public transport facilities, as well as the information processing apparatus 10 according to the first embodiment. The information processing apparatus 20 has a function of notifying the user that the user arrives at a place for transferring/a destination. Namely, the information processing apparatus 20 with a transfer/arrival precaution notifying function functions as the information processing apparatus with a transfer or arrival precaution notifying function.

The information processing apparatus 20 is of a portable type such as a personal computer of a notebook type. In order to realize the above function of notifying a user that the user arrives at a place for transferring/a destination, the information processing apparatus 20 has a signal transmitting unit 21, a notice data receiving unit 30 and a notifying unit 25.

The signal transmitting unit 21 transmits a signal for notifying the present position to the transfer/arrival notice transmitting apparatus (a remote apparatus) 31 via the geostationary satellite 28, which functions as the transmitting unit. The signal transmitting unit 21 has a structure similar to that of the signal transmitting unit 11 according to the first embodiment.

The notice data receiving unit 30 receives information relating to a positional relation between the present position and a place for transferring/a destination (the transfer/arrive precaution information) extracted correspondingly to the above signal transmitted by the signal transmitting unit 21 from the transfer/arrival notice transmitting apparatus 31, which functions as the positional relation information receiving unit.

A notifying unit 25 interrupts a state of another work to display the positional relation received by the notice data receiving unit 30 as the transfer/arrival precaution information (transfer or arrival precaution information), which functions as the displaying unit. The notifying unit 25 has a structure similar to that of the notifying unit 15 according to the first embodiment. A mode setting unit 26 and a mode setting table 26A provided in the notifying unit 25 have structures and functions similar to those of the mode setting unit 16 and the mode setting table 16A according to the first embodiment, respectively.

The transfer/arrival notice transmitting apparatus 31 has a position analyzing unit 29, a position information reading unit 22, a transfer/arrival position table 23, a transfer/arrival position confirming unit 24 and a notice data transmitting unit 32, in order to accomplish a function of notifying the information processing apparatus 20 that the information processing apparatus 20 arrives at a place for transferring/a destination. The transfer/arrival notice transmitting apparatus 31 can be configured with a system such as a computer or the like.

According to the second embodiment, the position information reading unit 22, the transfer/arrival position table 23 and the transfer/arrival position confirming unit 24 are provided in not the information processing apparatus 20 but the transfer/arrival notice transmitting apparatus 31, differently from the first embodiment.

Whereby, the transfer/arrival notice transmitting apparatus 31 can provide a service of realizing the transfer/arrival precaution notifying function to a plurality of information processing apparatus 20.

Accordingly, a function of the position information reading unit 22, a structure of the transfer/arrival position table 23 and a function of the transfer/arrival position confirming unit 24 differ from those according to the first embodiment.

When the position analyzing unit 29 receives present position coordinates information and identification information (possessor's ID) of the information processing apparatus 20 from the geostationary satellite 28, the position analyzing unit 29 specifies the present position of a relevant information processing apparatus 20 (a position in which a user of the information processing apparatus 20 from which the position detecting signal has been transmitted actually exists) on the basis of the coordinates information and the identification information, and sends it as a signal for detecting the present position [the nearest station/place (the nearest station or place)] of that information processing apparatus 20 to the position information reading unit 22.

The position information reading unit 22 has a signal receiving unit 22A (the position detecting signal receiving unit) for receiving the position detecting signal transmitted from the information processing apparatus 20 in a state of work operation during a move to a place for transferring/a destination utilizing public transport facilities via the position analyzing unit 29, and a present position detecting unit (the present position information detecting unit) 22B for detecting the present position of the information processing apparatus 20 during the move on the basis of the received signal from the signal receiving unit 22A.

In the transfer/arrival position table 23, there are registered in advance position information relating to a place for transferring at which the user transfers when utilizing public transport facilities and a final destination for each information processing apparatus 20. The transfer/arrival position table 23 functions as the transfer or arrival position table.

Figure 22:
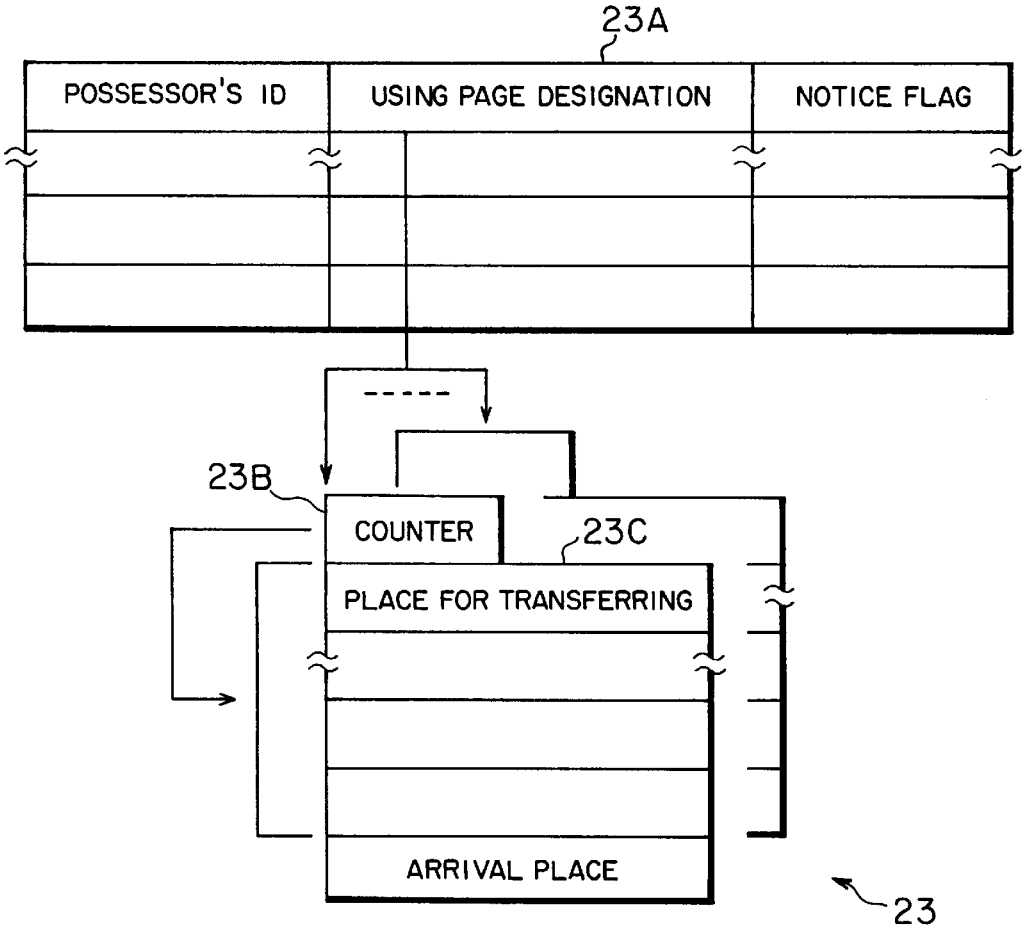
FIG. 22 is a diagram showing a structure of a transfer/arrival position table.

The transfer/arrival position table 23 has a using page designation table 23A, a count value (counter) 23B and a table 23C, as shown in FIG. 22, for example.

In the table 23C, there is registered position information relating to plural sets of a place for transferring/a destination according to a destination of a move and a using route of a user utilizing public transport facilities, with a count value 23B as the page information.

The using page designation table 23A holds "possessor's ID", "using page designation" and "notice flag" in such a manner that they are related to one another.

The "possessor's ID" is identification information by which the transfer/arrival notice transmitting apparatus 31 identifies the information processing apparatus 20, from which the position detecting signal has been transmitted, to confirm the present position of a relevant information processing apparatus 20, and transmits the transfer/arrival notice to that information processing apparatus 20.

The "using page designation" is used to store the page information (a count value) in the table 23C as the position information about a place for transferring/a destination designated by the user upon operation, as will be described later. The page information stored in the "using page designation" is pointed at a corresponding count value 23B in the table 23C.

The "notice flag" is used to designate whether the transfer/arrival notice is transmitted to the information processing apparatus 20 when the information processing apparatus 20 gets close to the place for transferring/the destination, or when the information processing apparatus 20 arrives at the place for transferring/the destination.

The transfer/arrival position confirming unit 24 extracts a positional relation between the present position and a place for transferring/a destination by referring to the transfer/arrival position table 23 on the basis of the present position detection information detected by the present position detecting unit 22B, which functions as the positional relation extracting unit. A manner of extracting a positional relation between the present position and a place for transferring/a destination by the transfer/arrival position confirming unit 24 is slightly different from the first embodiment since position information relating to a place for transferring/a destination is registered for each information processing apparatus 20 in the transfer/arrival position table 23.

The notice data transmitting unit 32 transmits the positional relation extracted by the transfer/arrival position confirming unit 24, which will be used in the information processing apparatus 20 as the transfer/arrival precaution information to be notified. The notice data transmitting unit 32 functions as the transfer or arrival precaution information transmitting unit. A signal from the notice data transmitting unit 32 is transmitted to the notice data receiving unit 30 via, for example, the geostationary satellite 28, a switching line or the like.

The geostationary satellite 28 relays transmission and reception of signals between the information processing apparatus 20 and the transfer/arrival notice transmitting apparatus 31, similarly to the geostationary satellite 18 according to the first embodiment. When receiving the position detecting signal from the signal transmitting unit 21 of the information processing apparatus 20, the geostationary satellite 28 extracts coordinates of the present position of an information processing apparatus 20 from which that signal has been transmitted (a position in which a user of that information processing apparatus 20 actually exists) among a plurality of information processing apparatus and identification information (possessor's ID) of that information processing apparatus 20, and transmits them to the transfer/arrival notice transmitting apparatus 31.

Actually, in the information processing apparatus 20 according to the second embodiment, a function corresponding to the signal transmitting unit 21, the notice data receiving unit 30 and the notifying unit 25 mentioned above is realized as an operation of a processor circuit (CPU, or the like) not shown by reading a program [hereinafer, referred as a transfer/arrival precaution notifying program (a transfer or arrival precaution notifying program)] recorded in a record medium (not shown) such as a disk apparatus, a CD-ROM or the like of a computer to a memory (RAM) not shown, activating the program, and executing the program by the processor circuit.

The transfer/arrival precaution notifying program makes the computer function, as a receiving-recognizing means (corresponding to the notice data receiving unit 30) which receives information for recognizing the present position during a move to a place for transferring/a destination as a radio signal from the outside to recognize the present position during the move from the received signal, and a notifying means (corresponding to the notifying unit 25) which displays a positional relation between the present position information recognized by the receiving-recognizing means and the place for transferring/the destination in public transport facilities to notify of it as the transfer/arrival precaution information.

In concrete, the transfer/arrival precaution notifying program makes the computer function, as a signal transmitting means (corresponding to the signal transmitting unit 21) for transmitting the position detecting signal used to show coordinates of the information processing apparatus 20 to the transfer/arrival notice transmitting apparatus 31 via the geostationary satellite 28, a notifying means (corresponding to the notifying unit 25) for displaying a positional relation between present position information recognized by the transfer/arrival notice transmitting apparatus 31 and a place for transferring/a destination in public transport facilities in a state of work operation to notify of it as the transfer/arrival precaution information [more concretely, interrupting a state of another work of the information processing apparatus 10 to display the positional relation extracted by the transfer/arrival notice transmitting apparatus 31 as the transfer/arrival precaution notice (transfer/arrival precaution information), thereby notifying a user that the user arrives at the place for transferring/the destination], a memorandum window displaying means (corresponding to the notifying unit 25) for displaying the window for memorandum on a display (not shown) of the information processing apparatus 20, in which the user of the information processing apparatus 20 records memorandum information when suspending a work and getting off the vehicle at the place for transferring/the destination in order to resume the work in the next occasion, and a mode setting means (corresponding to the mode setting unit 26) for setting a mode of display of the transfer/arrival precaution notice in the notifying means or whether the window for memorandum is displayed or not in the memorandum window displaying means.

In the transfer/arrival notice transmitting apparatus 31 according to the second embodiment, a function corresponding to the position analyzing unit 29, the position information reading unit 22, the transfer/arrival position cofirming unit 24 and the notice data transmitting unit 32 is realized as an operation of a processor circuit (CPU, or the like) not shown by reading a program [hereinafer, referred as a transfer/arrival precaution notice making program (a transfer or arrival precaution notice making program)] recorded in a record medium (not shown) such as a disk apparatus, a CD-ROM or the like of the computer to a memory (RAM) not shown, activating the program and executing the program by the processor circuit.

The transfer/arrival precaution notice making program makes the computer function, as a position analyzing means (corresponding to the position analyzing unit 29) for receiving present position coordinates information of an information processing apparatus 20 from the geostationary satellite 28 to analyze the present position of the information processing apparatus 20 on the basis of the coordinates information, a position detecting signal receiving means (corresponding to the signal receiving unit 22A) for receiving a signal for detecting the present position obtained by the position analyzing means, a present position information detecting means (corresponding to the present position detecting unit 22B) for detecting the present position of the information processing apparatus 20 during a move on the basis of the received signal from the position detecting signal receiving means, a transfer/arrival position confirming means (corresponding to the transfer/arrival position confirming unit 24) for extracting a positional relation between the present position and a place for transferring/a destination by referring to the transfer/arrival position table 23 on the basis of the present position detection information detected by the present position information detecting means, and a transfer/arrival precaution information transmitting means (corresponding to the notice data transmitting unit 32) for transmitting the positional relation extracted by the transfer/arrival position confirming means, which will be used in the information processing apparatus 20 as the transfer/arrival precaution information to be notified.

The transfer/arrival precaution notifying program and the transfer/arrival precaution notice making program are recorded in a computer readable record medium such as a CD-ROM or the like, read out from the CD-ROM or the like, and installed in a disk apparatus or the like of the computer (the information processing apparatus 20 or the transfer/arrival notice transmitting apparatus 31) to be used. The transfer/arrival precaution notifying program can be directly read out from, for example, a CD-ROM to be used, without being installed in a disk apparatus or the like of the computer (the information processing apparatus 20 or the transfer/arrival notice transmitting apparatus 31).

The transfer/arrival position table 23 is recorded in a record medium (not shown) such as a disk apparatus or the like of the transfer/arrival notice transmitting apparatus 31, and read out to a memory (RAM) not shown to be used. The mode setting table 26A is recorded in a record medium (not shown) such as a disk apparatus or the like of the information processing apparatus 20, and read out to a memory (RAM) not shown to be used.

The information processing apparatus with a transfer/arrival precaution notifying function according to the second embodiment with the above structure recognizes the present position during a move when the user works while moving to a place for transferring/a destination utilizing public transport facilities, and interrupts a state of another work to display a positional relation between the present position and the place for transferring/the destination set in advance (whether the present position is the place for transferring/the destination).

Namely, in the information processing apparatus 20, a signal for notifying the present position is transmitted to the transfer/arrival notice transmitting apparatus 31 (the transmitting step).

In the transfer/arrival notice transmitting apparatus 31, the signal receiving unit 22A receives the position detecting signal transmitted from the information processing apparatus 20 via the position analyzing unit 29 (the position detecting signal receiving step), and the present position detecting unit 22B detects the present position of the information processing apparatus 20 on the basis of the received signal from the signal receiving unit 22A (the present position information detecting step).

The transfer/arrival position confirming unit 24 extracts a positional relation between the present position detected by the present position detecting unit 22B and a place for transferring/a destination set in advance for each information processing apparatus 20 on the basis of the transfer/arrival position table 23 (the positional relation extracting step), and the notice data transmitting unit 32 transmits the extracted positional relation as the transfer/arrival precaution information to the information processing apparatus 20 (the transfer/arrival precaution information transmitting step).

In the information processing apparatus 20, the notice data receiving unit 30 receives information (information relating to a positional relation between the present position and the place for transferring/the destination) extracted correspondingly to the above signal transmitted from the notice data transmitting unit 32 of the transfer/arrival notice transmitting apparatus 31 (the positional relation information receiving step).

The notifying unit 25 interrupts a state of another work and displays the information relating to the positional relation received by the notice data receiving unit 30 as the transfer/arrival precaution information (the displaying step).

An operation of the information processing apparatus 20, and operations of the geostationary satellite 28 and the transfer/arrival notice transmitting apparatus 31 at this time will be described with reference to flowcharts shown in FIGS. 23 through 26.

Prior to use of the transferring/arrival precaution notifying function of the information processing apparatus 20, a registering process of the transfer/arrival position table 23 is performed in the transfer/arrival notice transmitting apparatus 31 to set a page of a place for transferring/a destination, input the number of places for transferring and the place for transferring, and input a destination.

Figure 23:
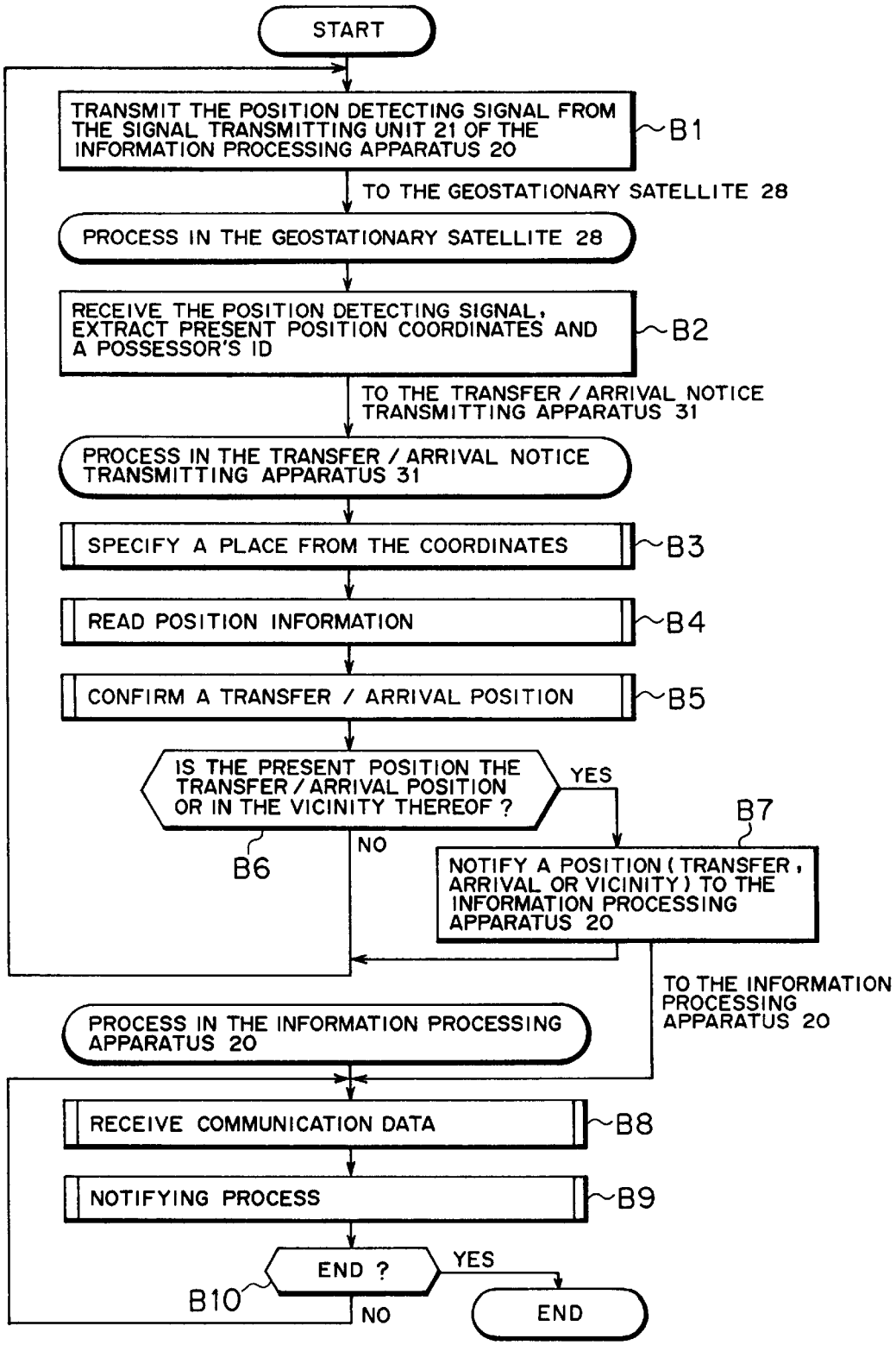
FIGS. 23 through 26 are flowcharts for illustrating operations of the transfer/arrival precaution notifying system to which the information processing apparatus with a transfer/arrival precaution notifying function according to the second embodiment of this invention is applied.

When the signal transmitting unit 21 of the information processing apparatus 20 transmits the position detecting signal for showing coordinates of the information processing apparatus 20 to the geostationary satellite 28 (Step B1 in FIG. 23), the geostationary satellite 28 extracts present position coordinates of the information processing apparatus 20 having transmitted the relevant signal and identification information (possessor's ID) of the information processing apparatus 20 from the position detecting signal, and transmits them to the transfer/arrival notice transmitting apparatus 31 (Step B2 in FIG. 23).

Figure 24:
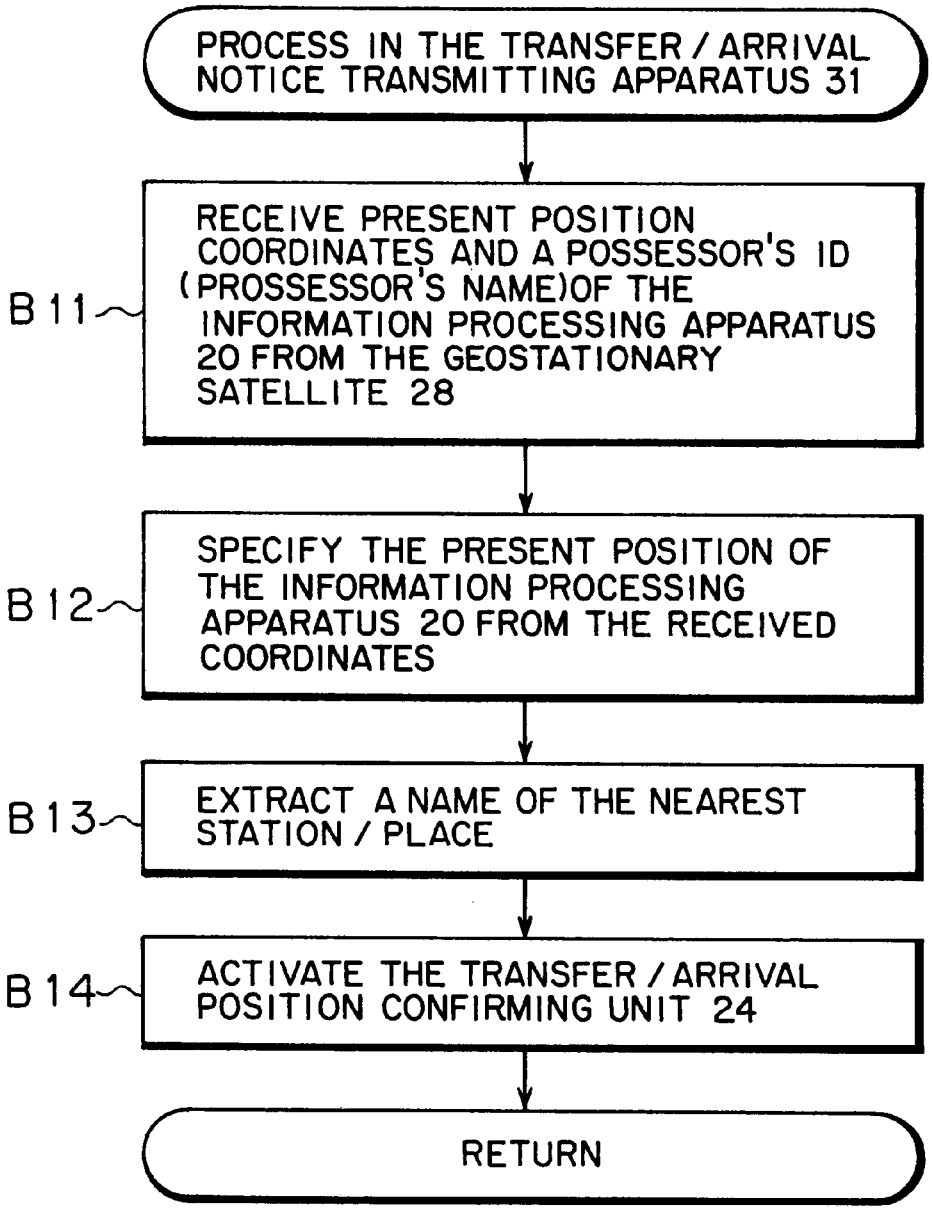

In the transfer/arrival notice transmitting apparatus 31, the position analyzing unit 29 receives the present position coordinates information and the identification information (Step B11 in FIG. 24), specifies the present position of the information processing apparatus 20 (a position in which a user of the information processing apparatus 20 actually exists) on the basis of the coordinates information and the identification information, and sends it to the position information reading unit 22 (Step B12 in FIG. 24; that is, the above Steps B11 and B12 correspond to Step B3 in FIG. 23).

In the position information reading unit 22, the signal receiving unit 22A of the position information reading unit 22 receives the signal from the position analyzing unit 29 to read position information (Step B4 in FIG. 23).

Namely, in the position reading unit 22, the present position detecting unit 22B extracts the present position (a name of the nearest station/place) during a move on the basis of the received signal from the signal receiving unit 22A (Step B13 in FIG. 24), and notifies the transfer/arrival position confirming unit 24 of it, whereby the transfer/arrival position confirming unit 24 is activated (Step B14 in FIG. 24).

The transfer/arrival position confirming unit 24 then confirms a transfer/arrival position (Steps B5 and B6 in FIG. 23).

Since the transfer/arrival position table 23 according to the second embodiment slightly differs from that according to the first embodiment, a process in the transfer/arrival position confirming unit 24 is also slightly different.

Figure 25:
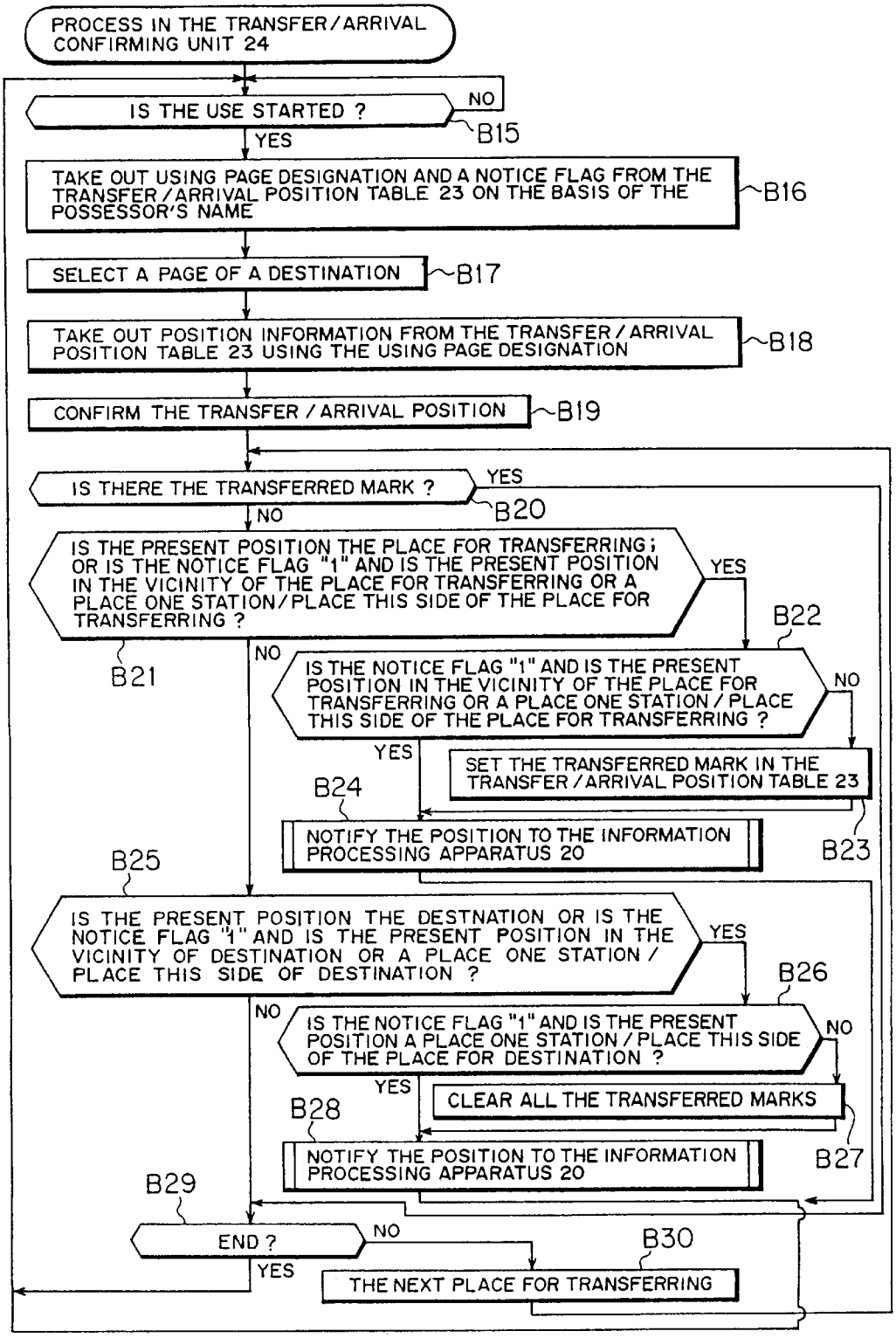

Namely, the transfer/arrival position confirming unit 14 determines whether or not use of the transfer/arrival precaution notifying function is started, in a manner similar to that at the abovementioned Step A17 in FIG. 8 (Step B15 in FIG. 25).

When receiving a notice from the position information reading unit 22, the transfer/arrival position confirming unit 24 takes out using page designation and a notice flag from the using page designation table 23A of the transfer/arrival position table 23 on the basis of a possessor's ID (a possessor's name) (Step B16 in FIG. 25).

Successively, the transfer/arrival position confirming unit 24 selects a page of an arrival place in the transfer/arrival position table 23 (Step B17 in FIG. 25), takes out position information relating to a place for transferring/a destination from the transfer/arrival position table 23 using the using page designation (Step B18 in FIG. 25), and starts confirmation of a place for transferring/a destination (Step B19 in FIG. 25).

At this time, it is determined whether or not there is the transferred mark showing that the user has arrived at a place for transferring and transferred in the position information taken out from the transfer/arrival position table 23 (Step B20 in FIG. 25).

If it is determined that there is no transferred mark (NO route at the above Step B20), it is determined whether a name of the nearest station/the nearest place extracted by the position information reading unit 22 (refer to Step B13 in FIG. 24) is a place for transferring shown in the transfer/arrival position table 23 or the notice flag is "1" and the present position is in the vicinity of a place for transferring (whether the present position is in the vicinity of the place for transferring or a place one station this side of the place for transferring, for example) (Step B21 in FIG. 25).

If it is determined that the present position is the place for transferring or the notice flag is "1" and the present position is in the vicinity of the place for transferring (YES route at the above Step B21), it is further determined whether the notice flag is "1" and the present position is in the vicinity of the place for transferring (Step B22 in FIG. 25). If the notice flag is "1" and the present position is in the vicinity of the place for transferring, the transferred mark is set in the transfer/arrival position table 23 (from NO route at the above Step B22 to Step B23 in FIG. 25).

After that, the notice data transmitting unit 32 transmits the extracted positional relation as transfer precaution notice to the information processing apparatus 20 (YES route at the above Step B22, or from the above Step B23 to Step B24 in FIG. 25; that is, Step B7 in FIG. 23).

If it is determined that the present position is not the place for transferring or the notice flag is "1" and the present position is not in the vicinity of the place for transferring (No route at the above Step B21), it is further determined whether a name of the nearest station/place is a destination shown in the transfer/arrival position table 23, or the notice flag is "1" and the present position is in the vicinity of an arrival place (the present position is in the vicinity of the arrival place or a place one station this side of the destination, for example) (Step B26 in FIG. 25).

If it is determined that the present position is the arrival place, or the notice flag is "1" and the present position is in the vicinity of the arrival place (YES route at the above Step B25), a process similar to that at the above Step B22 is conducted (Step B25 in FIG. 25), and the transferred mark is deleted in the transfer/arrival position table 23 in preparation for the next use (Step B27 in FIG. 25). A process similar to that at the above Step B24 is conducted after that (Step B28 in FIG. 25; that is, Step B7 in FIG. 23).

If it is determined at the above Step B20 that there is the transferred mark (YES route at the above Step B20), or it is determined at the above Step B25 that the present position is not the arrival place or the notice flag is "1" and the present position is not in the vicinity of the arrival place (NO route at the above Step B25), it is determined whether transfer/arrival position confirmation is terminated or not (Step B29 in FIG. 25).

If a plurality of places for transferring are set in the transfer/arrival position table 23, a process similar to that at the above Step A27 in FIG. 18 is conducted (Step B30 in FIG. 25). If the user does not yet arrive at the place for transferring/the arrival place, an operation at and after the above Step B15 is repeated (from YES route at the above Step B29 to the above Step B15).

In the information processing apparatus 20, the notice data receiving unit 30 receives the transfer/arrival precaution information from the notice data transmitting unit 32 (Step B8 in FIG. 23).

According to the second embodiment, a process for confirming a transfer/arrival position is conducted in the transfer/arrival notice transmitting apparatus 31. For this, a process for receiving the transfer/arrival precaution information is first conducted by the notice data receiving unit 30 in the information processing apparatus 20.

Figure 26:
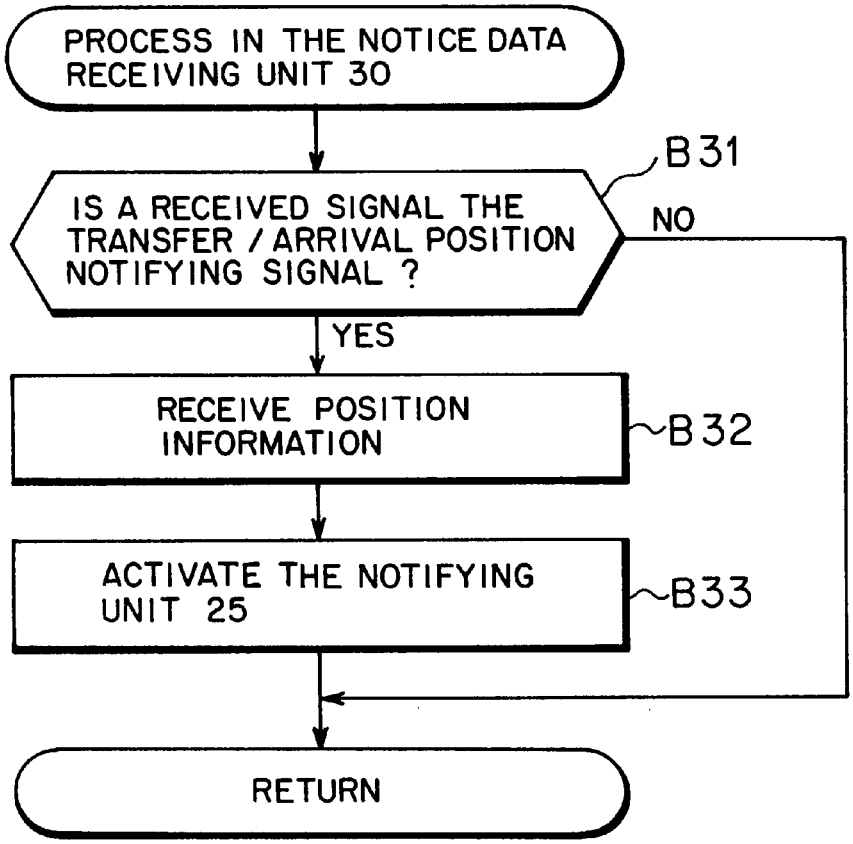

The notice data receiving unit 30 determines whether or not the received data is the transfer/arrival precaution information (a transfer/arrival position notifying signal) (Step B31 in FIG. 26). If the received data is the transfer/arrival precaution information, the notice data receiving unit 30 receives the transfer/arrival position information (place information) (Step B32 in FIG. 26), and activates the notifying unit 25 (Step B33 in FIG. 26).

The notifying unit 25 notifies the transfer/arrival precaution (Steps B9 and B10 in FIG. 23). Incidentally, a process and a control task corresponding to a mode setting value in the notifying unit 25 are here omitted since they are similar to those described before in the first embodiment.

The information processing apparatus 20 with a transfer/arrival precaution notifying function according to the second embodiment of this invention interrupts a state of another work in the information processing apparatus 20 to display a positional relation between the present position of the information processing apparatus 20 and a place for transferring/a destination in public transport facilities as the transfer/arrival precaution information so as to bring the same advantage as the first embodiment.

In particular, according to the information processing apparatus 20 of the second embodiment, the process of confirming a place for transferring/a destination is conducted in the transfer/arrival notice transmitting apparatus 31. Therefore, it is possible to decrease a memory capacity required in the information processing apparatus 20.

The second embodiment has been described by way of an example where the transfer/arrival position confirming unit 24 takes out the using page designation and the notice flag from the transfer/arrival position table 23 (refer to Step B16 in FIG. 25). It is alternatively possible that the using page is not changed according to a use but fixed.

As the transfer/arrival position confirming process conducted by the transfer/arrival position confirming unit 24, a process similar to the transfer/arrival position confirming process (the above Steps A20 through A27 in FIG. 8) described in the first embodiment may be applied other than the process described at Steps B19 through B30 in FIG. 25.

(c1) Description of a Modification of the Second Embodiment

Figure 27:
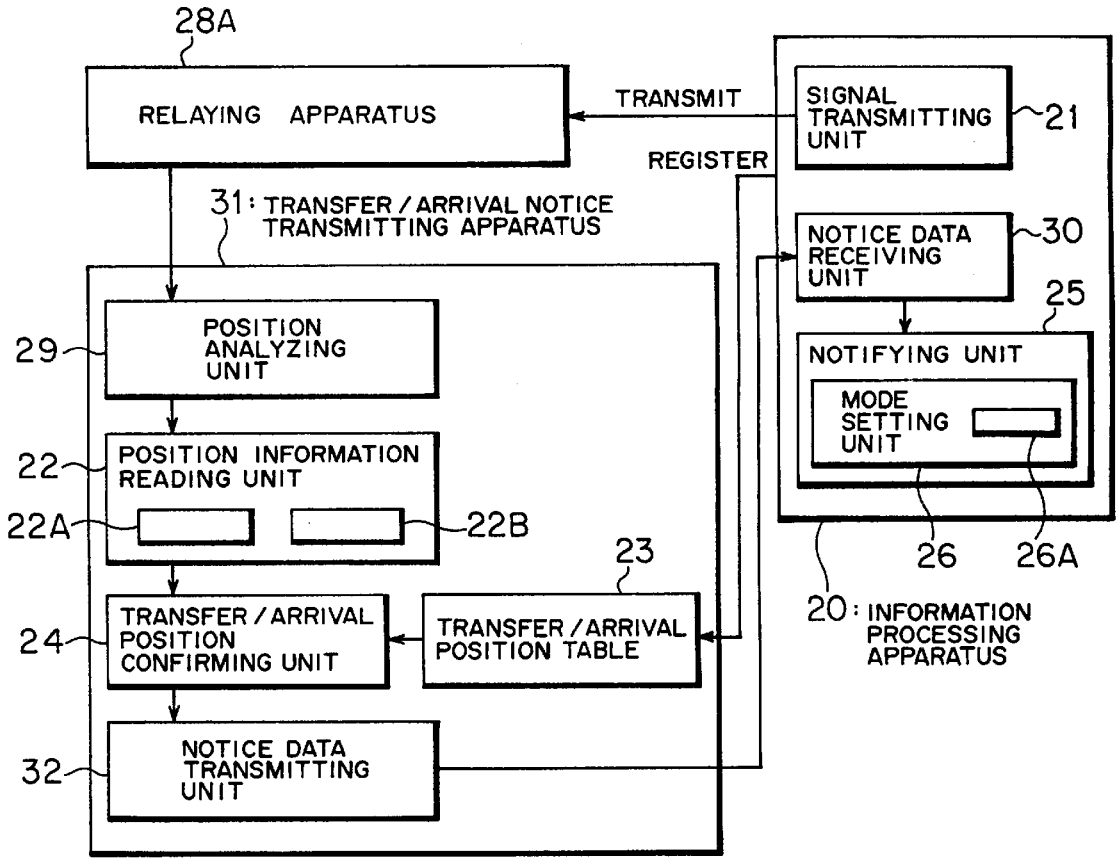
FIG. 27 is a block diagram showing the transfer/arrival precaution notifying system to which an information processing apparatus with a transfer/arrival precaution notifying function according to a modification of the second embodiment of this invention is applied.

FIG. 27 is a block diagram showing a transfer/arrival precaution notifying system to which an information processing apparatus with a transfer/arrival precaution notifying function according to a modification of the second embodiment of this invention is applied. The transfer/arrival precaution notifying system has an information processing apparatus 20A, a repeating apparatus 28A and a transfer/arrival notice transmitting apparatus 31.

The information processing apparatus 20A with a transfer/arrival precaution notifying function shown in FIG. 27 is also carried by a user, with which the user can work while moving to a place for transferring/a destination utilizing public transport facilities, the information processing apparatus 20A having a function of notifying the user that the user arrives at the place for transferring/the destination. Namely, the information processing apparatus with a transfer/arrival precaution notifying function functions as the information processing apparatus with a transfer or arrival precaution notifying function.

The information processing apparatus 20A according to the modification has a structure similar to the information processing apparatus 20 according to the second embodiment, excepting that the information processing apparatus 20A is provided with a repeating apparatus 28A instead of the geostationary satellite 28, as compared with the information processing apparatus 20.

The repeating apparatus 28A relays transmission and reception of signals between the information processing apparatus 20A and the transfer/arrival notice transmitting apparatus 31, which has a function similar to that of the geostationary satellite 28 according to the second embodiment. The repeating apparatus 28A is installed at a public transport facility (a vehicle such as a train, a bus or the like, or a station, a bus stop or the like).

Namely, in the information processing apparatus 20A according to this modification, the signal transmitting unit 21 transmits a signal for notifying the present position to the transfer/arrival notice transmitting apparatus 31 via not the geostationary satellite 28 but the repeating apparatus 28A.

Figure 28:
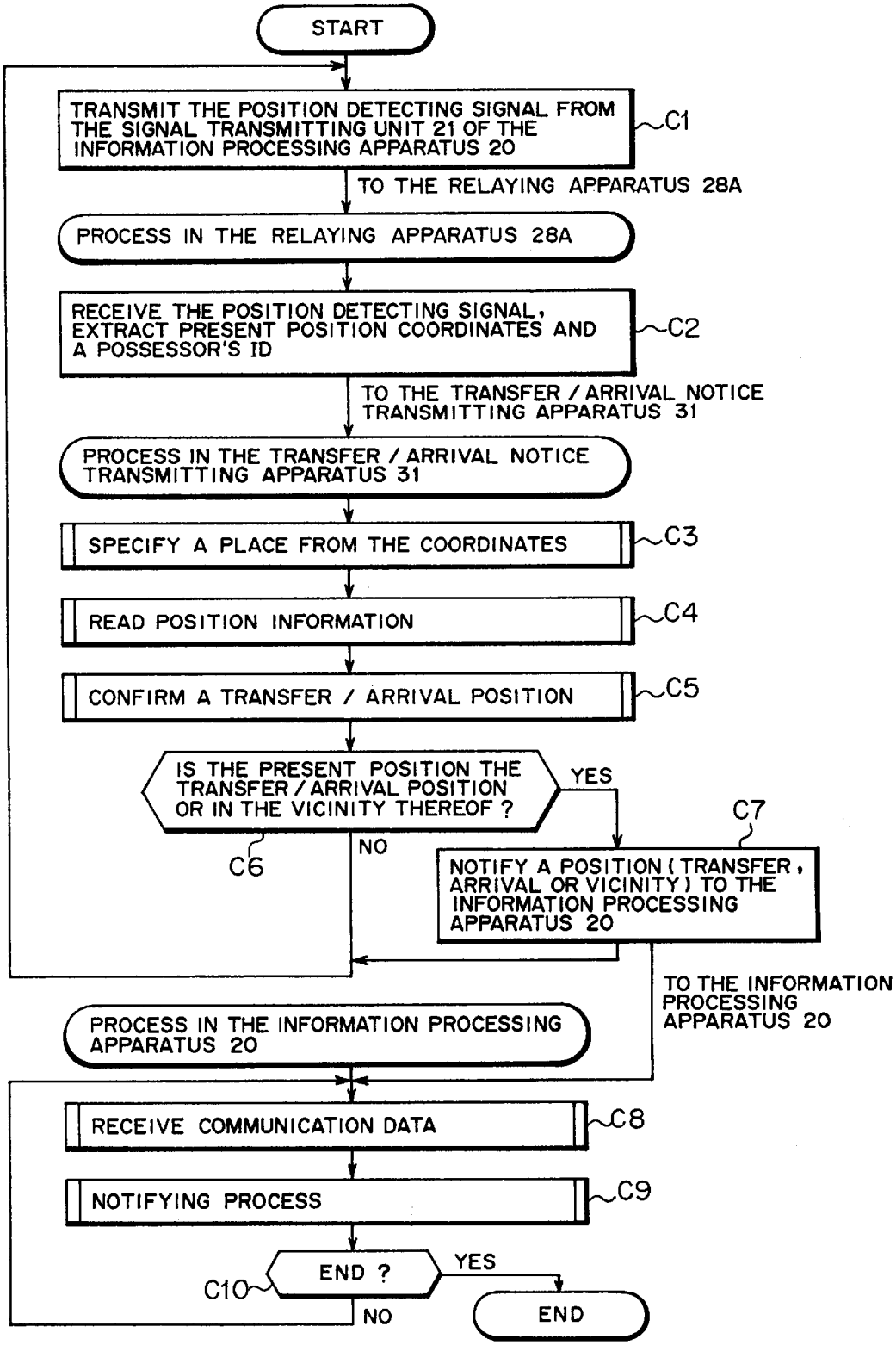
FIG. 28 is a flowchart for illustrating operations of the transfer/arrival precaution notifying system to which the information processing apparatus with a transfer/arrival precaution notifying function according to the modification of the second embodiment is applied.

According to this modification, processes similar to those described in the second embodiment are conducted (refer to Steps C1 through C10 in FIG. 28), excepting that the process conducted by the geostationary satellite 28 according to the second embodiment is conducted by the repeating apparatus 28A.

With the above structure, it is also possible to decrease a memory capacity required in the information processing apparatus 20A.

It is alternatively possible that the repeating apparatus 28A has only a function of transmitting and receiving signals, a geostationary satellite similar to the geostationary satellite 28 according to the second embodiment is provided, and the signal transmitting unit 21 transmits a signal for notifying the present position to the transfer/arrival notice transmitting apparatus 31 via the repeating apparatus 28A and the geostationary satellite. In which case, the relevant geostationary satellite conducts the process conducted by the geostationary satellite 28 in the second embodiment.

(d) Others

In each of the above embodiments, the signal transmitting unit 11 or 21 transmits the position detecting signal when the transfer/arrival precaution notifying function is used. It is alternatively possible that the signal transmitting unit 11 or 21 transmits the position detecting signal at all times (namely, even when the transfer/arrival precaution notifying function is not used).

In each of the above embodiment, the transfer/arrival position confirming unit 14 or 24 traces the present position by using the transferred mark set in the transfer/arrival position table 13 or 23 to confirm a place for transferring/a destination. It is, however, alternatively possible to use a pointer in such a manner that a pointer is set to the next place for transferring when the information processing apparatus 10 or 20 passes through a place for transferring to confirm a place for transferring/a destination without using the transferred mark.

It is also possible that the transfer/arrival position confirming unit 14 or 24 does not detect the first station at which the user gets on the vehicle when the transfer/arrival position confirming unit 14 or 24 selects a page of a destination, but determines a page of a position to which the user moves.

In each of the above embodiments, the notifying unit 15 or 25 has the mode setting unit 16 or 26, as shown in FIGS. 2, 18, 21 and 27. It is alternatively possible that the mode setting unit 16 or 26 is provided in a structural element other than the notifying unit 15 or 25 in the information processing apparatus 10, 10A, 20 or 20A.

Further, it is alternatively possible that there is used a control in a power saving mode upon transferring, a battery for the window for memorandum is separately provided, further a flag showing whether the window for memorandum is displayed or not when the user resumes the work is set as a mode setting value in the mode setting table 16A or 26A, and if the flag is "on" ("open"), the window for memorandum in which a note is described is immediately opened when the user resumes the work, whereby an effect of continuation of the work is improved by the note even upon a power down.

Registering in the transfer/arrival position table 23 in the second embodiment is possible with not the information processing apparatus 20 or 20A but another information processing apparatus.

The above transfer/arrival notice transmitting apparatus 31 according to the second embodiment may be provided with a move history tracing unit (refer to a reference numeral 17 in FIG. 18) as described in the modification of the first embodiment to make the transfer/arrival position table 23 using a move history traced by the move history tracing unit.

With the above structure, the transfer/arrival notice transmitting apparatus 31 can grasp any time the present position of the information processing apparatus by tracing the move history by the move history tracing unit. It is thereby possible to accomplish not only the transfer/arrival precaution notifying function but also a searching function when the information processing apparatus is lost because of mislaying, theft or the like.

What is claimed is:

1. An information processing apparatus with a transfer or arrival precaution notifying function carried by a user, with which the user can work while moving to a place for transferring or a destination utilizing transport facilities, comprising:

a receiving-recognizing unit for receiving information for recognizing the present position during a move to said place for transferring or said destination as a signal from the outside to recognize the present position during the move from said received signal; and a notifying unit for displaying a positional relation between said present position information recognized by said receiving-recognizing unit and said place for transferring or said destination in a state of work operation, thereby notifying of transfer or arrival precaution information.

2. The information processing apparatus with a transfer or arrival precaution notifying function according to claim 1 further comprising a memorandum window displaying unit for displaying a window for memorandum in which memorandum information can be recorded when a user of said information processing apparatus suspends said work so that the user can resume the work in the next occasion.

3. The information processing apparatus with a transfer or arrival precaution notifying function according to claim 1, wherein said notifying unit increases a size of a display as the positional relation between said present position and said place for transferring or said destination gets closer.

4. An information processing apparatus with a transfer or arrival precaution notifying function carried by a user, with which the user can work while moving to a place for transferring or a destination utilizing transport facilities, comprising:

a position detecting signal receiving unit for receiving a signal for detecting the present position during the move from a geostationary satellite while said information processing apparatus moves to said place for transferring or said destination;

a present position information detecting unit for detecting the present position during the move on the basis of the received signal from said position detecting signal receiving unit;

a transfer or arrival position table in which position information relating to said place for transferring or said destination is registered in advance;

a positional relation extracting unit for extracting a positional relation between the present position and said place for transferring or said destination by referring to said transfer or arrival position table on the basis of said present position detection information detected by said present position information detecting unit; and a displaying unit for interrupting a state of another work to display said positional relation extracted by said positional relation extracting unit as transfer or arrival precaution information.

5. The information processing apparatus with a transfer or arrival precaution notifying function according to claim 4 further comprising a move history tracing unit for tracing a move history utilizing said transport facilities on the basis of said present position information during the move from said present position information detecting unit, wherein the move history traced by said move history tracing unit is used as register information of said transfer or arrival position table.

6. The information processing apparatus with a transfer or arrival precaution notifying function according to claim 4, wherein said transfer or arrival position table is made on the basis of a habit of using said transport facilities.

7. An information processing apparatus with a transfer or arrival precaution notifying function carried by a user, with which the user can work while moving to a place for transferring or a destination utilizing transport facilities, comprising:

a transmitting unit for transmitting a signal for notifying of a present position to a remote apparatus;

a positional relation information receiving unit for receiving information relating to a positional relation between said present position and the place for transferring or the destination extracted correspondingly to said signal having been transmitted by said transmitting unit from said remote apparatus; and a displaying unit for interrupting a state of another work to display said positional relation received by said positional relation information receiving unit as transfer or arrival precaution information.

8. The information processing apparatus with a transfer or arrival precaution notifying function according to claim 7, wherein said transmitting unit transmits the signal for notifying of the present position to said remote apparatus via a geostationary satellite.

9. The information processing apparatus with a transfer or arrival precaution notifying function according to claim 7, wherein said transmitting unit transmits the signal for notifying of the present position to said remote apparatus via said transport facility.

10. An apparatus for transmitting information for transfer or arrival precaution comprising:

a position detecting signal receiving unit for receiving a position detecting signal transmitted from an information processing apparatus in a state of work operation while said information processing apparatus moves to a place for transferring or a destination utilizing transport facilities;

a present position information detecting unit for detecting the present position of said information processing apparatus during the move on the basis of the received signal from said position detecting signal receiving unit;

a transfer or arrival position table in which position information relating to said place for transferring or said destination is registered in advance for each information processing apparatus;

a positional relation extracting unit for extracting a positional relation between the present position and said place for transferring or said destination by referring to said transfer or arrival position table on the basis of said present position detection information detected by said present position detecting unit; and a transfer or arrival precaution information transmitting unit for transmitting said positional relation extracted by said positional relation extracting unit so that said information processing apparatus uses said positional relation as transfer or arrival precaution information to be notified.

11. The apparatus for transmitting information for transfer or arrival precaution according to claim 10 further comprising a move history tracing unit for tracing a move history utilizing said transport facilities on the basis of said present position information during the move from said present position information detecting unit, wherein the move history traced by said move history tracing unit is used as register information of said transfer or arrival position table.

12. The apparatus for transmitting information for transfer or arrival precaution according to claim 10, wherein said transfer or arrival position table is made on the basis of a habit of using said transport facilities.

13. A transfer or arrival precaution notifying method used in an information processing apparatus carried by a user, with which the user works while moving to a place for transferring or a destination utilizing transport facilities, comprising the steps of:

a position detecting signal receiving step of receiving a signal for detecting a present position during the move from a geostationary satellite;

a present position information detecting step of detecting the present position during the move on the basis of the received signal obtained at said position detecting signal receiving step;

a positional relation extracting step of extracting a positional relation between said present position detected at said present position information detecting step and the place for transferring or the destination set in advance for each information processing apparatus; and a displaying step for interrupting a state of another work to display said positional relation extracted at said positional relation extracting step as transfer or arrival precaution information.

14. A transfer or arrival precaution notifying method used in an information processing apparatus carried by a user, with which the user works while moving to a place for transferring or a destination utilizing transport facilities, comprising the steps of:

a transmitting step of transmitting a signal for notifying of the present position from said information processing apparatus to a remote apparatus;

a position detecting signal receiving step of receiving said position detecting signal transmitted from said information processing apparatus by said remote apparatus;

a present position information detecting step of detecting the present position of said information processing apparatus during the move on the basis of said received signal obtained at said position detecting signal receiving step;

a positional relation extracting step of extracting a positional relation between said present position detected at said present position information detecting step and the place for transferring or the destination set in advance for each information processing apparatus;

a transfer or arrival precaution information transmitting step of transmitting said positional relation extracted at said positional relation extracting step as transfer or arrival precaution information;

a positional relation information receiving step of receiving information relating to said positional relation between said present position and said place for transferring or said destination extracted correspondingly to said signal transmitted at said transfer or arrival precaution information transmitting step by said information processing apparatus; and a displaying step of interrupting a state of another work to display said positional relation received at said positional relation information receiving step as transfer or arrival precaution information.

15. A computer readable record medium in which a program used to operate said computer is recorded, the improvement comprising:

said program making said computer function as a receiving-recognizing means for receiving information for recognizing the present position during a move to a place for transferring or a destination in transport facilities as a signal from the outside to recognize said present position during the move from said received signal, and a notifying means for displaying a positional relation between said present position information recognized by said receiving-recognizing means and said place for transferring or said destination in said transport facilities to notify of transfer or arrival precaution information in a state of a work operation of said computer.

* * * * *